United States Patent [19]

Kurosu et al.

[11] Patent Number: 5,050,559

[45] Date of Patent: Sep. 24, 1991

[54] FUEL INJECTION CONTROL SYSTEM FOR A TWO-CYCLE ENGINE

[75] Inventors: Shinichi Kurosu, Ageo; Mitsugi Chonan, Koga; Fusao Tachibana, Shiraoka; Kazuo Suzuki, Ageo; Yoshiki Yuzuriha, Isezaki, all of Japan

[73] Assignees: Fuji Jukogyo Kabushiki Kaisha, Tokyo; Japan Electronic Control Systems Co., Ltd., Gunma, both of Japan; Polaris Industries L.P., Minneapolis, Minn.

[21] Appl. No.: 603,274

[22] Filed: Oct. 25, 1990

[51] Int. Cl.[5] ..... F02D 41/04

[52] U.S. Cl. ..... 123/478; 123/73 A; 123/494

[58] Field of Search ..... 123/73 A, 73 B, 73 C, 123/179 L, 478, 491, 494

[56] References Cited

U.S. PATENT DOCUMENTS

| | | | |
|---|---|---|---|
| 4,446,833 | 5/1984 | Matsushita et al. | 123/73 C X |
| 4,564,907 | 1/1986 | Mouri et al. | 123/491 X |
| 4,739,741 | 4/1988 | Iwata et al. | 123/491 |
| 4,892,078 | 1/1990 | Fukutomi et al. | 123/491 X |
| 4,920,790 | 5/1990 | Stiles et al. | 123/478 X |
| 4,960,097 | 10/1990 | Tachibana et al. | 123/73 A X |
| 4,987,773 | 1/1991 | Stiles et al. | 123/478 X |

FOREIGN PATENT DOCUMENTS

| | | |
|---|---|---|
| 63-29039 | 2/1988 | Japan . |
| 63-255543 | 10/1988 | Japan . |

*Primary Examiner*—Willis R. Wolfe

*Attorney, Agent, or Firm*—Martin A. Farber

[57] ABSTRACT

A crankcase temperature sensor is provided for detecting temperature of a crankcase. A low speed basic injection pulse width is provided based on the detected crankcase temperature for low engine speed. An ordinary fuel injection pulse width is provided in accordance with engine operating conditions for ordinary engine operating condition. A comparator is provided for comparing the low speed injection pulse width and the ordinary fuel injection pulse width with each other. A larger injection pulse width is determined for injecting fuel.

3 Claims, 31 Drawing Sheets

FUEL INJECTION CONTROL SYSTEM FOR A TWO-CYCLE ENGINE

BACKGROUND OF THE INVENTION

The present invention relates to a fuel injection control system for a two-cycle engine having an electronic control system such as a microcomputer.

The fuel injection control system having the microcomputer is widely used in a four-cycle engine.

A recent two-cycle engine is also equipped with an electronic control system for controlling various components of the engine, such as fuel injectors. Japanese Patent Application Laid-Open 63-255543 discloses such an electronic fuel injection control system for the engine. The system has a main intake pipe for inducing fresh air to a crankcase and a sub intake pipe for directly inducing fresh air to the crankcase. A fuel injector is provided in each of the intake pipes. An electronic control unit is provided for controlling the injection timing and quantity of fuel injected from the fuel injector.

Japanese Patent Application Laid-Open 63-29039 discloses a system in which the quantity of intake air Q is derived from a look-up table in accordance with throttle valve opening degree $\alpha$ and engine speed N as parameters for calculating a basic fuel injection quantity Tp. Fuel injection quantity is calculated by correcting the basic fuel injection quantity with various correcting quantities in accordance with engine operating conditions. Coolant temperature, intake air temperature and atmospheric pressure are usually used as parameters for determining the engine operating conditions.

In the two-cycle engine, the intake air is induced in a crankcase and compressed before being transferred to a combustion chamber. Thus the charging efficiency of the engine is affected by the temperature of the crankcase. Namely, the charging efficiency decrease with an increase of the crankcase temperature.

On the other hand, a snowmobile, on which the two-cycle engine is mounted, is driven under various ambient conditions, so that the temperature of the crankcase decrease to about −50° and increase up to 100° C. Therefore, coolant temperature does not accurately represent the crankcase temperature so that an optimum air-fuel ratio cannot be obtained.

Moreover, if the quantity of fuel to injected is determined irrespective of the crankcase temperature, when the engine is restarted a large quantity of fuel is injected. Although the engine is already warmed up, thereby excessively enriching the air-fuel mixture. Hence the engine cannot be properly started.

SUMMARY OF THE INVENTION

The object of the present invention is to provide a fuel injection control system for a two-cycle engine where the engine is properly started although ambient temperature under which the engine is operated greatly varies.

According to the present invention, there is provided a fuel injection control system for a two-cycle engine having a crankcase, a fuel injector and a microcomputer for cotrolling the engine in with operating conditions of the engine, the system comprising a crankcase temperature sensor for detecting temperature of the crankcase, low speed pulse width providing means for providing a low speed basic injection pulse width based on the detected crankcase temperature, correcting means for reducing the low speed basic injection pulse width with an elapse of time for providing a low speed injection pulse width, and ordinary pulse width providing means for providing an ordinary fuel injection pulse width in accordance with engine operating conditions. The low speed injection pulse width and the ordinary fuel injection pulse width are compared with each other by a comparator, and a larger injection pulse width is determined. The fuel injection is operated at the larger injection pulse width for injecting fuel.

In an aspect of the invention, the ordinary injection pulse width is corrected with the detected crankcase temperature.

The system fuel comprises first pulse width providing means for providing a first injection pulse width based on the detected crankcase temperature at cranking of the engine.

The other objects and features of this invention will become understood from the following description with reference to the accompanying drawings.

DETAILED DESCRIPTION OF THE PREFERRED EMBODIMENTS

Figure 1A:
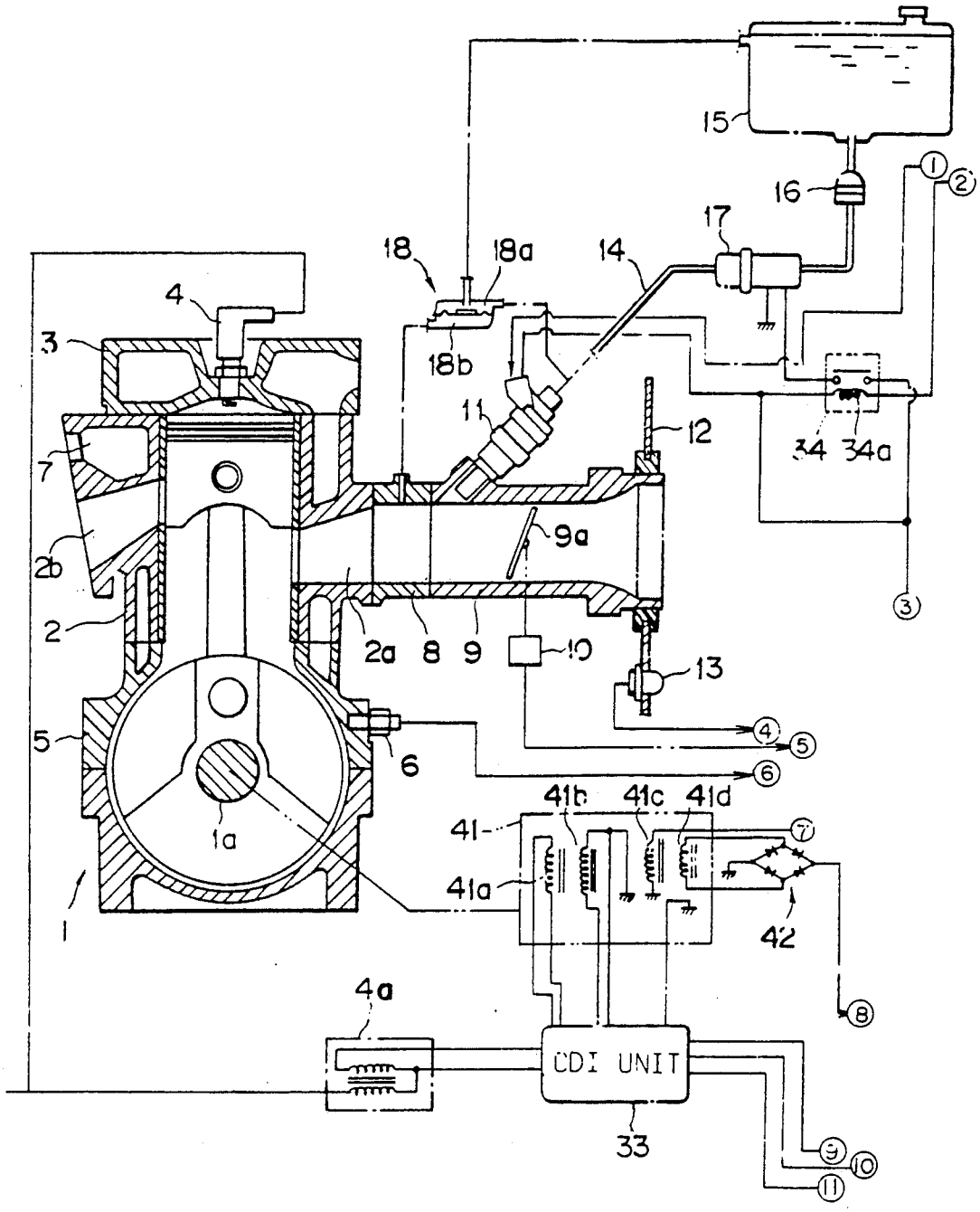
FIGS. 1*a* to 1*c* are schematic diagrams showing a control system for an engine including a circuit of the present invention.
Figure 1B:
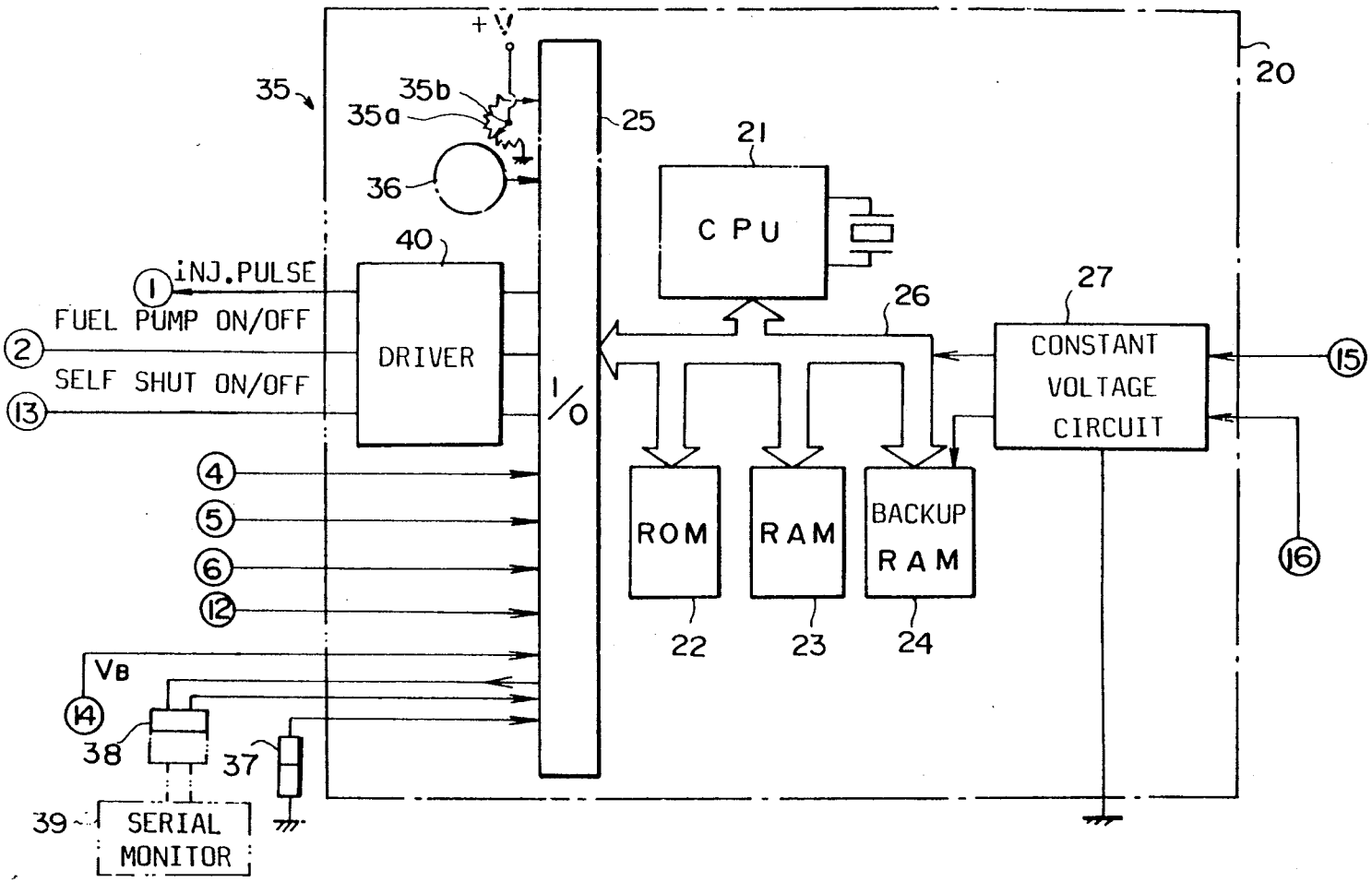
Figure 1C:
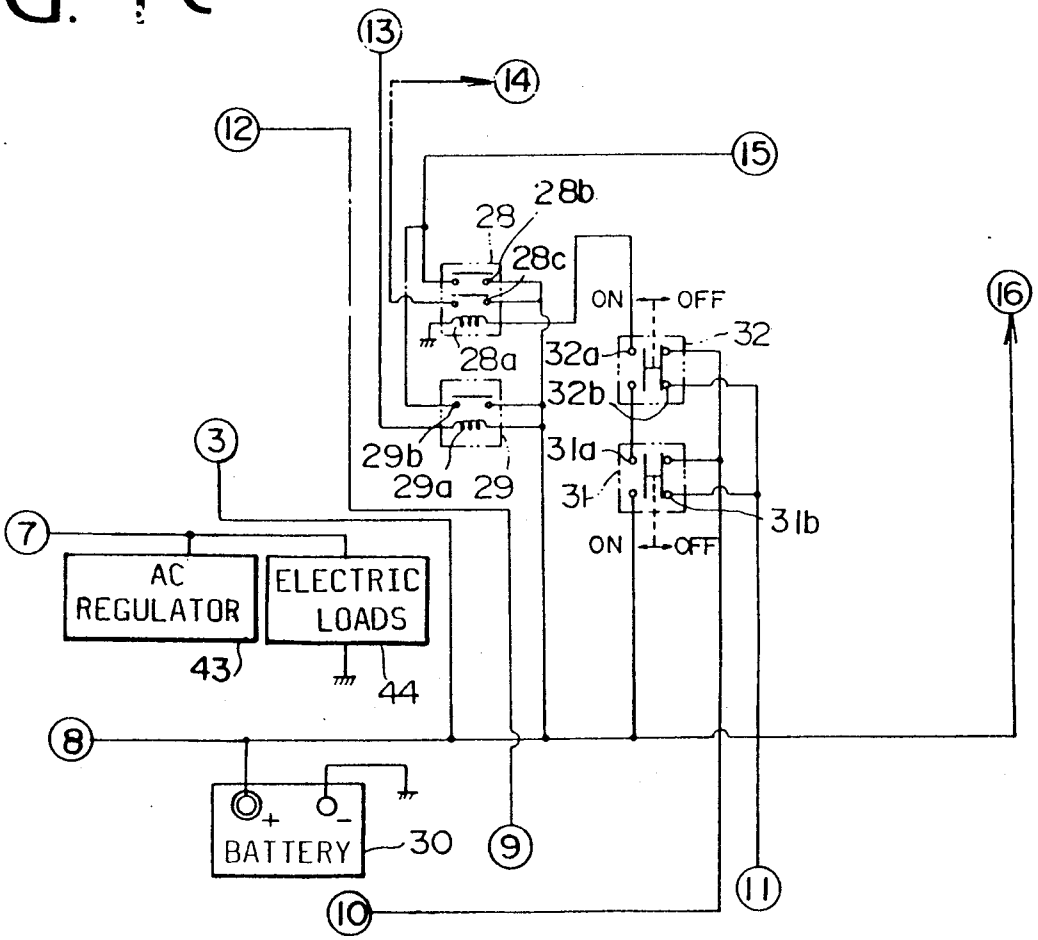

Referring to FIGS. 1*a* to 1*c* showing a two-cycle three-cylinder engine 1 for a snowmobile, a cylinder 2 of the engine 1 has an intake port 2*a* and an exhaust port 2*b*. A spark plug 4 is located in each combustion chamber formed in a cylinder head 3. A crankcase temperature sensor 6 is provided on a crankcase 5. Water jackets 7 are provided in the crankcase 5, cylinder 2 and cylinder head 3. The intake port 2*a* is communicated with an intake manifold 9 through an insulator 8. A throttle valve 9*a* is provided in the intake manifold 9. A throttle position sensor 10 is attached to the intake manifold 9. A fuel injector 11 is provided in the intake manifold 9 adjacent the intake port 2*a*. The intake manifold 9 is communicated with an air box 12 having an air cleaner (not shown). An intake air temperature sensor 13 is mounted on the air box 12.

Fuel in a fuel tank 15 is supplied to the injector 11 through a fuel passage 14 having a filter 16 and a pump 17.

The fuel injector 11 is communicated with a fuel chamber 18*a* of a pressure regulator 18 and the fuel tank 15 is communicated with an outlet of the fuel chamber 18*a*. A pressure regulating chamber 18*b* is communicated with the intake manifold 9.

The fuel in the tank 15 is supplied to the fuel injector 11 and the pressure regulator 18 by the pump 17 through the filter 16. The difference between the inner pressure of the intake manifold 9 and the fuel pressure applied to the injector 11 is maintained at a predetermined value by the pressure regulator 18 so as to prevent the fuel injection quantity of the injector 11 from changing.

An electronic control unit (ECU) 20 having a microcomputer comprises a CPU (central processing unit) 21, a ROM 22, a RAM 23, a backup RAM 24 and an input/output interface 25, which are connected to each other through a bus line 26. A predetermined voltage is supplied from a constant voltage circuit 27. The constant voltage circuit 27 is connected to a battery 30 through a contact 28*b* of an ECU relay 28 and a contact 29*b* of a self-shut relay 29 which are parallely connected with each other. Furthermore, the battery 30 is directly connected to the constant voltage circuit 27 so that the backup RAM 24 is backed up by the battery 30 so as to maintain the stored data even if a key switch (not shown) is in off-state. Sensors 6, 10 and 13 are connected to input ports of the input/output interface 25. An atmospheric pressure sensor 36 is provided in the control unit 20 and connected to an input port of the input/output interface 25. Output ports of the interface 25 are connected to a driver 40 which is connected to injectors 11 and a coil 34*a* of a relay 34 for the pump 17.

The ECU relay 28 has a pair of contacts 28*b* and 28*c* and an electromagnetic coil 28*a*. As hereinbefore described, the contact 28*b* is connected to the constant voltage circuit 27 and the battery 30. The other contact 28*c* is connected to the input port of the I/O interface 25 and the battery 30 for monitoring the voltage VB of the battery 30. The coil 28*a* of the relay 28 is connected to the battery 30 through ON-terminals 32*a*, 31*a* of a kill switch 32 and an ignition switch 31.

The kill switch 32 is provided on a grip (not shown) of the snowmobile to stop the snowmobile.

ON-terminals 31*a* and 32*a* of the ignition switch 31 and the kill switch 32 are connected to each other in series and OFF-terminals 31*b* and 32*b* of switches 31 and 32 are connected to each other in parallel. When both the switches 31 and 32 are turned on, power from the battery 30 is supplied to the coil 28*a* of the relay 28 to excite the coil to close each contact. Thus, the power from the battery 30 is supplied to the constant voltage circuit 27 through the contact 28*b* for controlling the control unit 20.

The self-shut relay 29 has the contact 29*b* connected to the constant voltage circuit 27 and the battery 30 and a coil 29*a* connected to the output port of the I/O interface 25 through the driver 40 and the battery 30.

When one of the switches 31 and 32 is turned off, the engine stops. After the stop of the engine, the power from the battery 30 is supplied to the coil 29*a* of the self-shut relay 29 for a predetermined period (for example, ten minutes) by the operation of the control unit, thereby supplying the power to the control unit 20 for the period.

When the engine is restarted while the engine is warm within the period, the quantity of fuel injected from the injector 11 is corrected to a proper value, so that the restart of the engine in hot engine condition is ensured.

The battery 30 is further connected to the coil 34*a* of the fuel pump relay 34 and to the injector 11 and the pump 17 through a contact of the relay 34.

Furthermore, a capacitor discharge ignition (CDI) unit 33 is provided as an ignition device. The CDI unit 33 is connected to a primary coil of an ignition coil 4*a* and to the spark plug 4 through a secondary coil. A signal line of the CDI unit 33 is connected to the input port of the I/O interface 25 of the control unit 20 for applying CDI pulses. When one of the switches 31 and 32 is turned off, lines for the CDI unit are short-circuited to stop the ignition operation.

A magneto 41 for generating alternating current is connected to a crankshaft 1*a* of the engine 1 to be operated by the engine. The magneto 41 has an exciter coil 41*a*, a pulser coil 41*b*, a source coil 41*c*, and a charge coil 41*d*. The pulser coil 41*b* is connected to the CDI unit 33. The source coil 41*c* is connected an AC regulator 43, so that the voltage is regulated, and the regulated voltage is applied to an electric load 44 such as lamps, a heater and various accessories of the vehicle. Namely, the regulated output of the magneto is independently supplied to the electric load 44. The charge coil 41*d* is connected to the battery 30 through a rectifier 42.

The power from the battery 30 is supplied to the electric loads of the electronic control system such as the injector 11, pump 17, control unit 20, coils 28*a*, 29*a* and 34*a* of relays 28, 29 and 34. During engine operation, the alternating current from the charge coil 41*d* is rectified by the rectifier 42 to charge the battery 30.

The CPU 21 calculates a fuel injection pulse width appropriate for the various engine operating conditions in accordance with the control programs stored in the ROM 22. The I/O interface 25 produces a driving signal of the pulse width as a trigger signal of the CDI pulse signal which is applied to the fuel injector 11 through the driver 40.

As a self-diagnosis function of the system, a connector 37 for changing a diagnosis mode and a connector 38 for diagnosing the engine are connected to the input ports of the I/O interface 25. A serial monitor 39 is connected to the control unit 20 through the connector 38. The trouble mode changing connector 37 operates to change the self-diagnosis function of the control unit 20 into either a U(user)-check mode or D(dealer)-check mode. In normal state, the connector 37 is set in the U-check mode. When an abnormality occurs in the system during the driving of the vehicle, trouble data are stored and kept in the backup RAM 24. At a dealer's shop, the serial monitor 39 is connected through the connector 38 to read the data stored in the RAM 24 for diagnosing the trouble of the system. The connector 37 is changed to the D-check mode to diagnose the trouble more in detail.

The ECU 20 further has an idle speed adjuster 35. The idle speed adjuster 35 is, for example, a potentiometer having a resistor 35*a* one end of which is connected to the I/O interface 25, and a movable contact 35*b* connected to a constant voltage source +V. The movable contact 35*a* is manually operated to change the output terminal voltage VMR which is a factor for adjusting a fuel injection pulse width as idling.

Figure 2A:
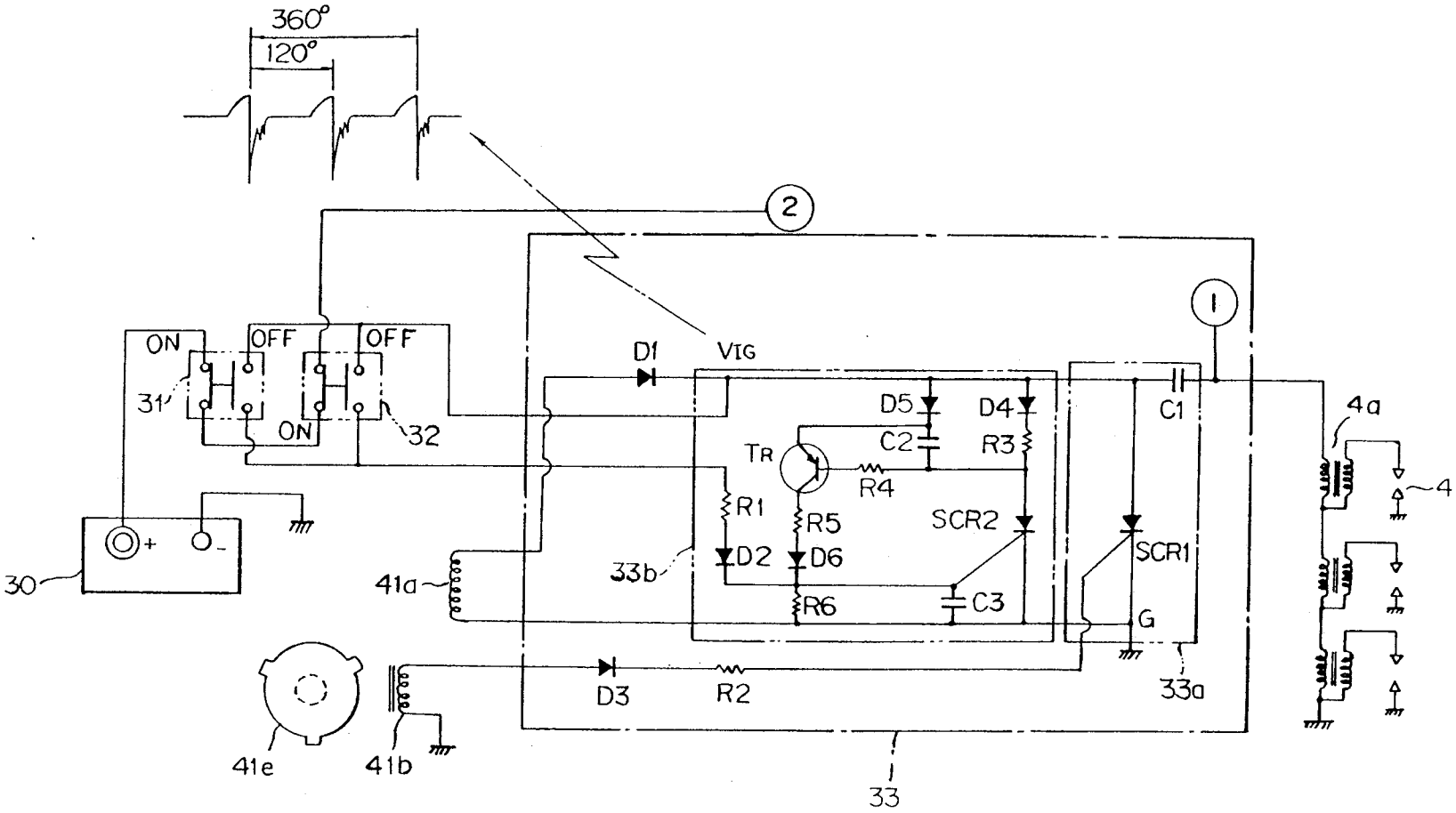
FIGS. 2*a* and 2*b* show a circuit of a CDI unit provided in the control system.
Figure 2B:
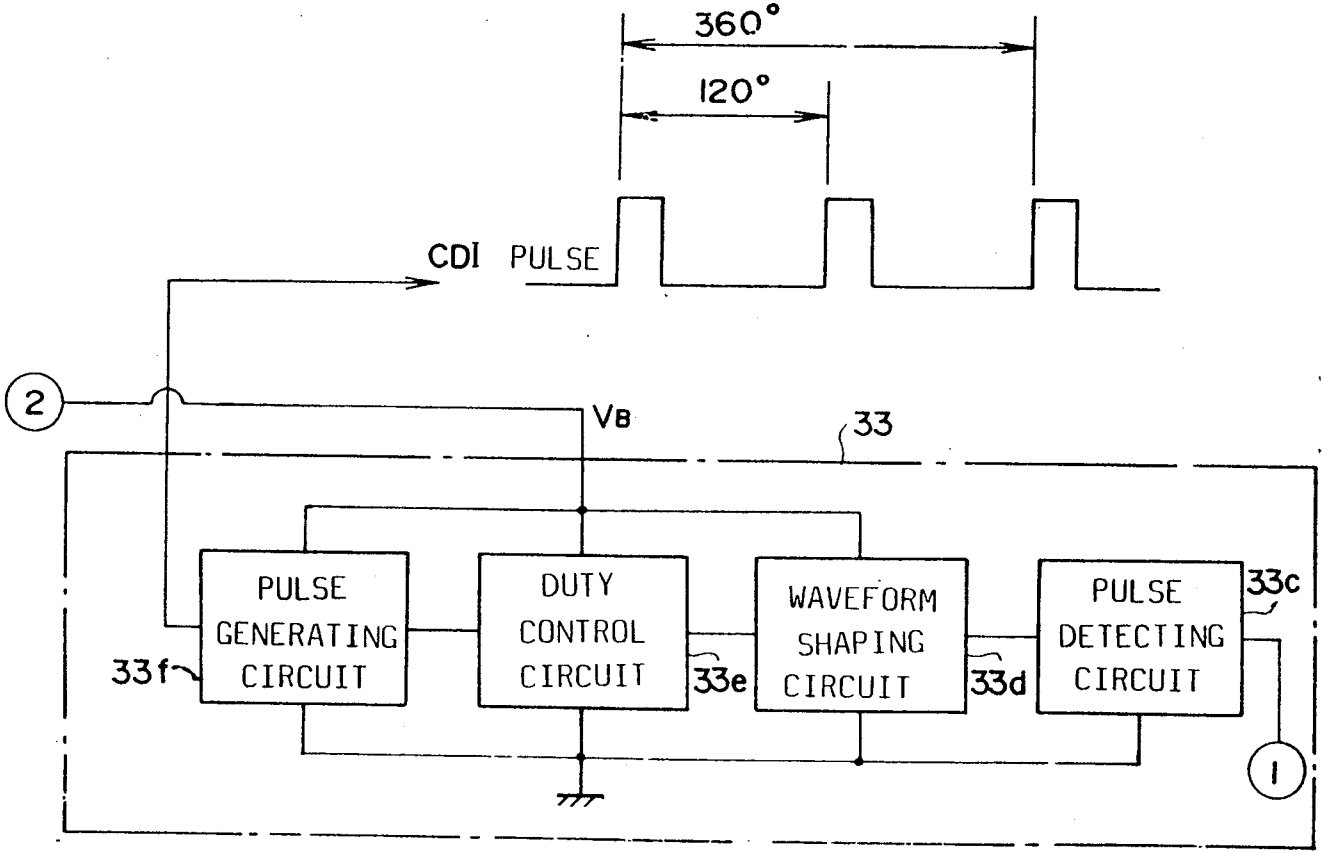

Referring to FIGS. 2*a* and 2*b* showing the CDI unit 33, the exciter coil 41*a* is connected to an ignition source VIG of an ignition source short-circuiting circuit 33*b* through a diode D1. The ignition source short-circuiting circuit 33*b* has a first diode D4 and a second diode D5 anodes of which are connected to the source VIG. Cathodes of the diodes D4 and D5 are connected to an anode of a thyristor SCR2 through a resister R3 and a capacitor C2, respectively. A cathode of the thyristor SCR2 is connected to the ground G. The cathode of the second diode D5 is further connected to an emitter of a PNP transistor TR. A base of the transistor TR is connected to the anode of the thyristor SCR2 through a resister R4. A collector of the transistor TR is connected to a gate of the thyristor SCR2 through a resister R5 and a diode D6. A resister R6 and a capactior C3 are connected between the gate of the thyristor SCR2 and the ground G in parallel to each other for preventing noises and commutation caused by an increasing rate of critical off voltage.

OFF-terminals of the ignition switch 31 and the kill switch 32 are connected to the source VIG and to the gate of the thyristor SCR2 through a resister R1 and a diode D2.

An ignition circuit 33*a* is a well-known capacitor discharge ignition circuit and comprises a capacitor C1 and a thyristor SCR1 to which the source VIG is connected. The pulser coil 41*b* is connected to a gate of the thyristor SCR1 through a diode D3 and a resister R2. The pulser coil 41*b* is provided adjacent a crank angle sensor disk 41*e* of the magneto 41.

Figure 3:
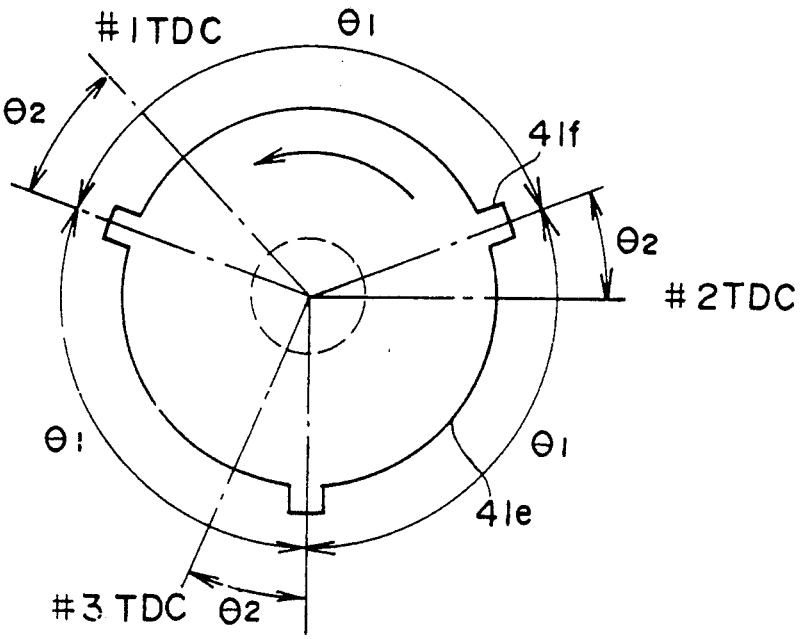
FIG. 3 is a front view showing a crank angle disk in the CDI unit.

Referring to FIG. 3, the crank angle sensor disk 41*e* has three projections (notches) 41*f* formed on an outer periphery thereof at equal intervals $\theta 1$ (120 degrees). The projections 41*f* represent the before top dead center (BTDC) $\theta 2$ (for example 15 to 20 degrees) of No.1 to No.3 cylinders. When the disk 41*e* is rotated, the pulser coil 41*b* detects the positions of the projections 41*f* in accordance with electromagnetic induction and produces an ignition trigger signal in the form of a pulse.

The trigger signal is applied to the thyristor SCR1 at a predetermined timing. The thyristor SCR1 is connected to the ground G. The capacitor C1 is connected to the primary coils 4*a* of the spark plugs 4 and to a pulse detecting circuit 33*c*.

The CDI unit 33 further comprises a waveform shaping circuit 33*d*, a duty control circuit 33*e* and a pulse generating circuit 33*f* which are connected to the battery 30 through ON-terminals of the kill switch 32 and the ignition switch 31. The pulse generating circuit 33*f* produces CDI pulse signals (FIG. 3) in synchronism with the source VIG. The CDI pulse signals are applied to the I/O interface 25 of the control unit 20 as hereinbefore described.

In the present invention, the pulser coil 41*b* produces an ignition trigger signal at every crank angle 120° to ignite three cylinders at the same time. The pulse generating circuit 33*f* produces a CDI pulse signal at every crank angle 120° to inject fuel from the fuel injectors 11 in three cylinders at the same time.

Figure 4A:
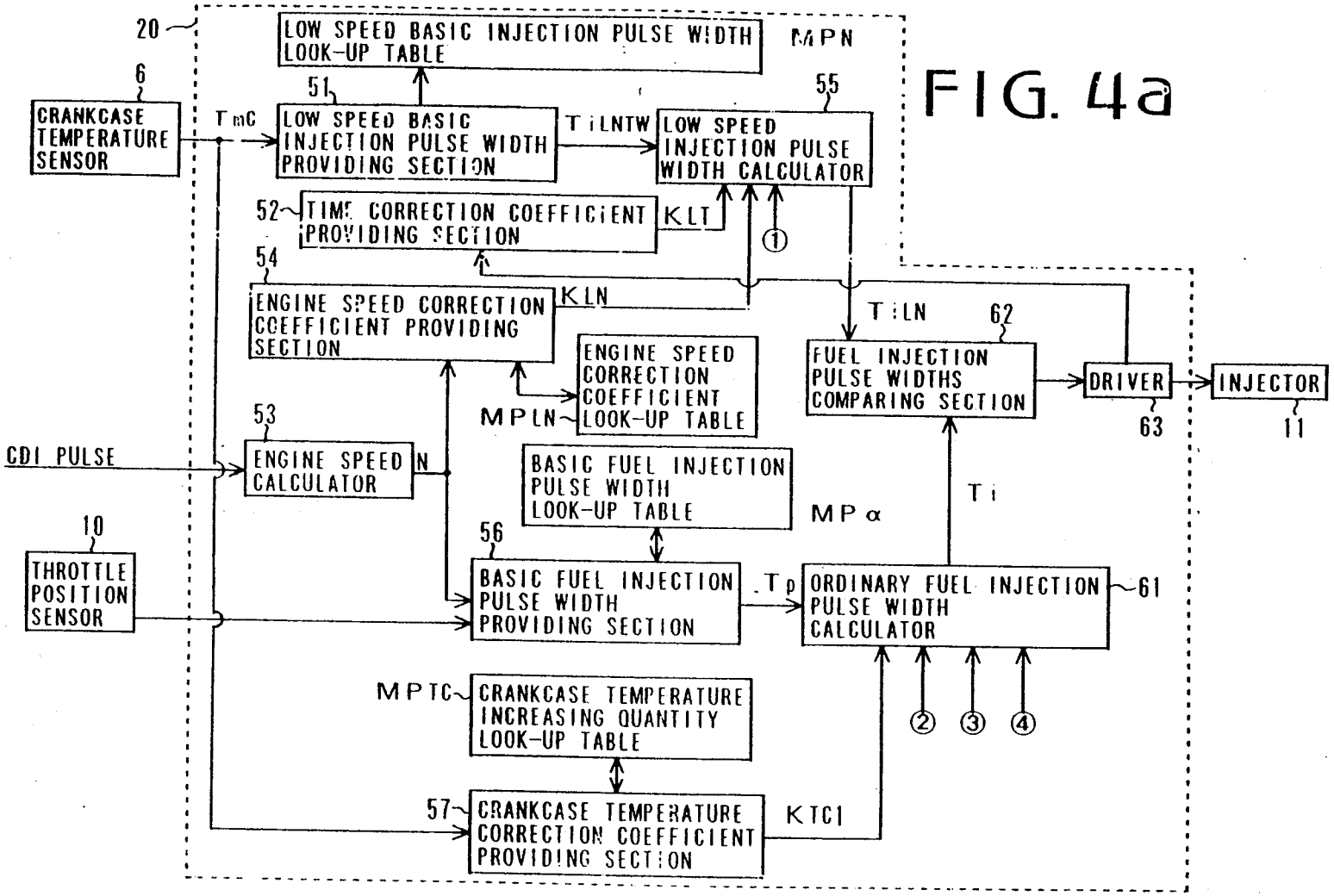
FIGS. 4*a* and 4*b* show a block diagram of the control system.
Figure 4B:
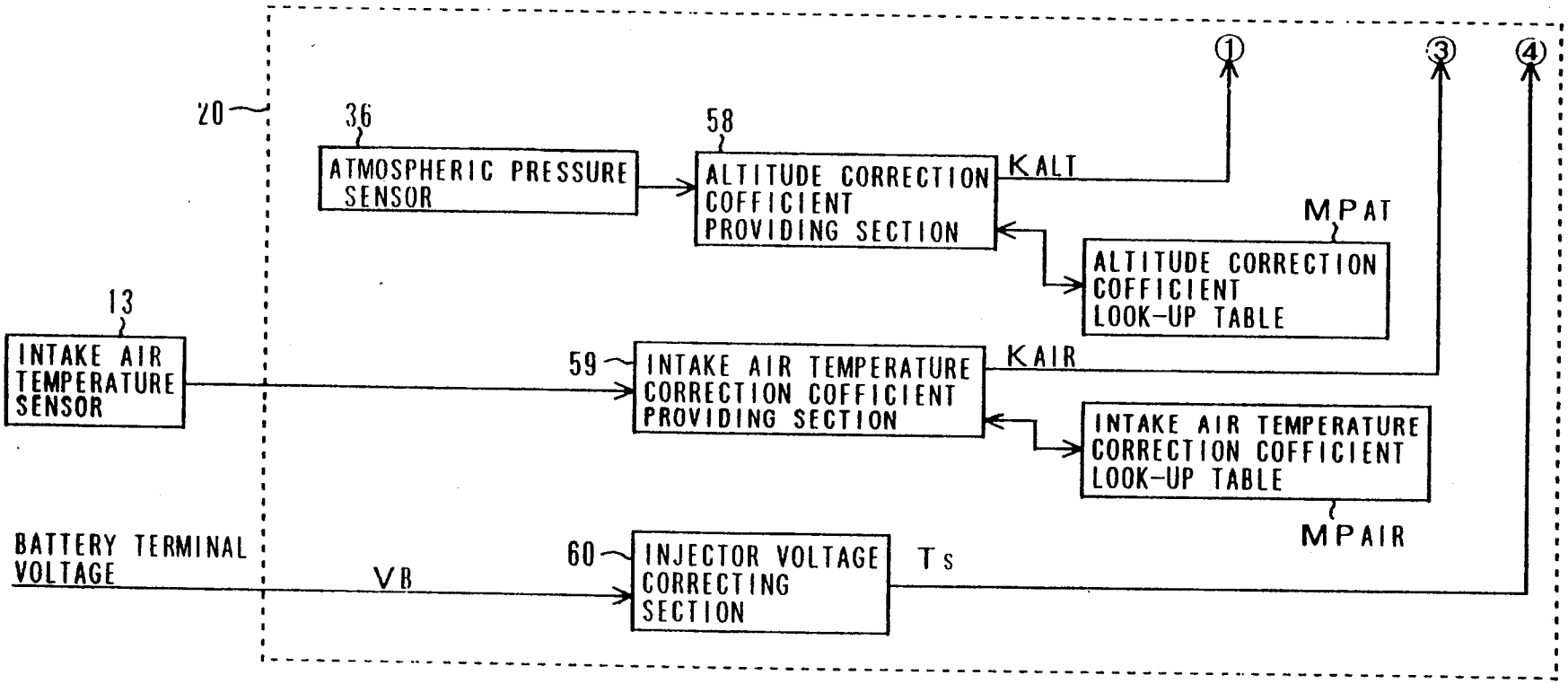

Referring to FIGS. 4*a* and 4*b*, the ECU 20 has an engine speed calculator 53 to which the CDI pulse signals from the CDI unit 33 is fed to calculate the engine speed N. A cycle f is obtained from a time interval T120 between each CDI pulse in and the equal angular interval $\theta 1$ in accordance with, $$f = dT120/d\theta 1$$

The engine speed N is calculated based on the cycle f as follows.

$$N = 60/(2\pi \cdot f)$$

The engine speed N calculated in the calculator 53 and the throttle opening degree $\alpha$ detected by the throttle position sensor 10 are applied to a basic fuel injection pulse width providing section 56. The basic fuel injection pulse width providing section 56 retrieves a basic fuel injection pulse width Tp from a three-dimensional basic fuel injection pulse width look-up table MP$\alpha$ provided in the ROM 22. The basic fuel injection pulse width look-up table MP$\alpha$ stores a plurality of basic fuel injection pulse widths Tp arranged in accordance with the engine speed N and the throttle opening degree $\alpha$ so as to inject an appropriate quantity of fuel dependency on the position of the throttle valve 9*a*.

The ECU 20 has a crankcase temperature correction coefficient providing section 57 to which a crankcase temperature TmC is fed. The crankcase temperature correction coefficient providing section 57 retrieves a crankcase temperature increasing quantity KTC from a crankcase temperature increasing quantity look-up table MPTC and calculates a crankcase temperature correction coefficient KTC1 based on the crankcase temperature increasing quantity KTC in accordance with KTC1 = 1 + KTC.

Figure 5:
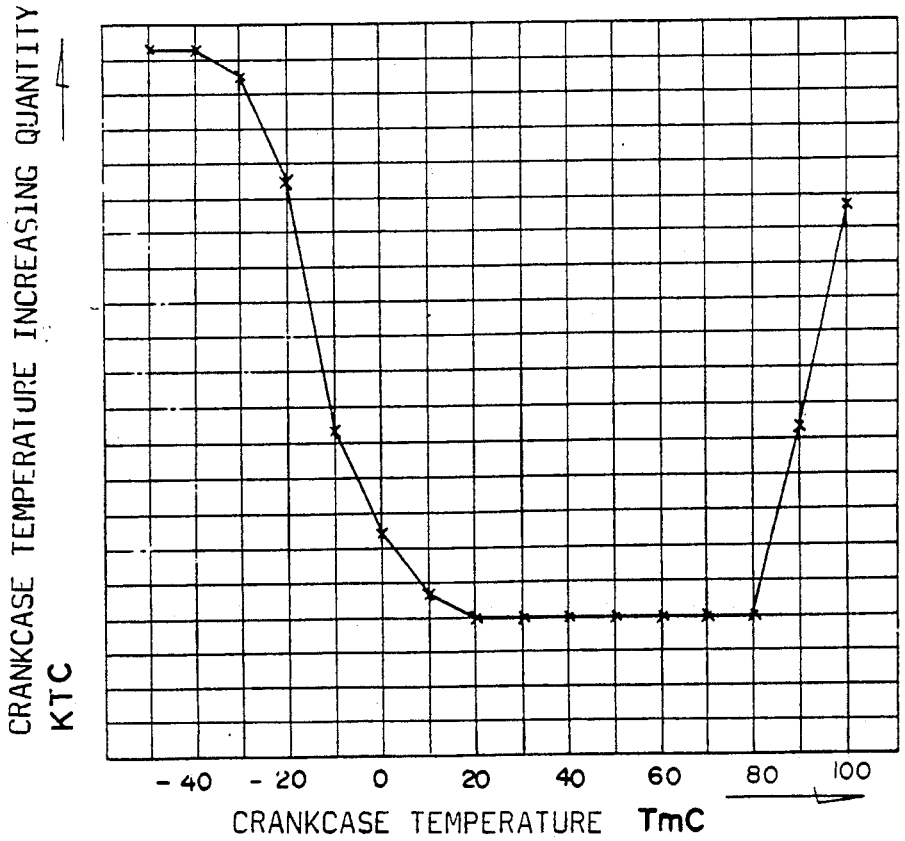
FIG. 5 is a graph showing a relationship between crankcase temperature increasing quantity and crankcase temperature.

The crankcase temperature increasing quantity look-up table MPTC is provided in the ROM 22 and stores a plurality of crankcase temperature increasing quantities KTC arranged in accordance with the crankcase temperature TmC. As shown in FIG. 5, in a crankcase temperature range of 20° to 80° C., the crankcase temperature increasing quantity KTC is constant. In the lower temperature range, the crankcase temperature increasing quantity KTC is set at a large value to improve the starting characteristic at the start of the engine, and in the higher crankcase temperature range, the crankcase temperature increasing quantity is increased in consideration to the intake efficiency.

Figure 6:
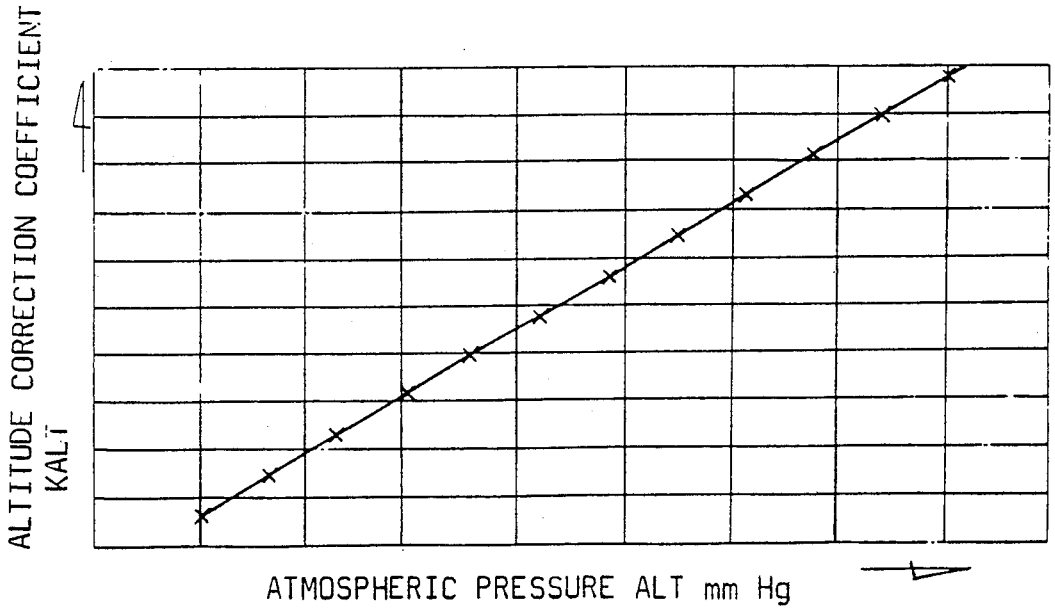
FIG. 6 is a graph showing a relationship between altitude correction coefficient and atmospheric pressure.

An altitude correction coefficient provided section 58 to which an atmospheric pressure ALT is fed provides an altitude correction coefficient KALT retrieved from an altitude correction coefficient look-up table MPAT. The altitude correction coefficient table MPAT provided in the ROM 22 stores a plurality of altitude correction coefficients KALT arranged in accordance with the atmospheric pressure ALT. The altitude correction coefficient KALT can be calculated by interpolation based on the coefficients retrieved from the table MPAT. As shown in FIG. 6, at a low altitude where the atmospheric pressure ALT is normal at substantially 760 mmHg, the altitude correction coefficient KALT is set at 1 and decreases with the increase of the altitude to reduce the quantity of fuel to be injected. Thus, the fuel injection quantity can be decreased in accordance with the decrease of the intake air density when the vehicle is driven at a high altitude.

Figure 7:
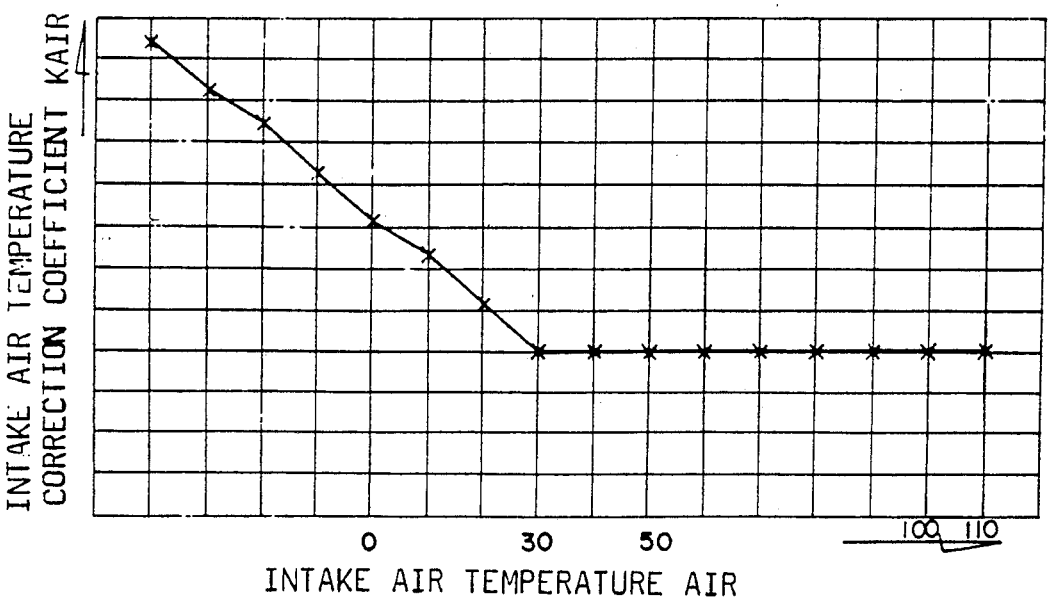
FIG. 7 is a graph showing a relationship between intake air temperature correction coefficient and intake air temperature.

An intake air temperature correction coefficient providing section 59 is applied with an intake air temperature AIR from the intake air temperature sensor 13. The providing section 59 retrieves an intake air temperature correction coefficient KAIR from an intake air temperature correction coefficient look-up table MPAIR. The intake air temperature correction coefficient table MPAIR is provided in the ROM 22 and stores a plurality of intake temperature correction coefficients KAIR arranged in accordance with the intake air temperature AIR. As shown in FIG. 7, the intake air correction coefficient KAIR is set at a standard value 1 between the air temperature 30° and 110° C. When the temperature is lower than 30° C., the intake temperature correction coefficient KAIR is set to a value larger than 1 in dependency on the density of intake air. The intake air temperature correction coefficient may be calculated by interpolation based on the coefficients retrieved from the table MPAIR.

When the voltage of the battery 30 decreases, the effective injection pulse width actually provided by the injector 11 reduces. In order to correct the reduction of the pulse width, an injector voltage correcting section 60 is provided in the ECU 20. The injector voltage correcting section 60 has a look-up table (not shown) storing a plurality of invalid pulse widths in accordance with the terminal voltage VB of the battery 30. The invalid pulse width is a period of time within which fuel is not injected although the voltage VB is applied to the injector. An injector voltage correcting width Ts corresponding to the invalid pulse width retrieved from the table is provided in the section 60.

The basic fuel injection pulse width Tp, crankcase temperatures correction coefficient KTC1, altitude correction coefficient KALT, intake air temperature correction coefficient KAIR and the injector voltage correcting width Ts are applied to an ordinary fuel injection pulse width calculator 61 where an ordinary injection pulse width Ti for the ordinary engine operation range is calculated as follows.

$$Ti = Tp \times KALT \times KAIR \times KTC1 + Ts$$

Figure 8:
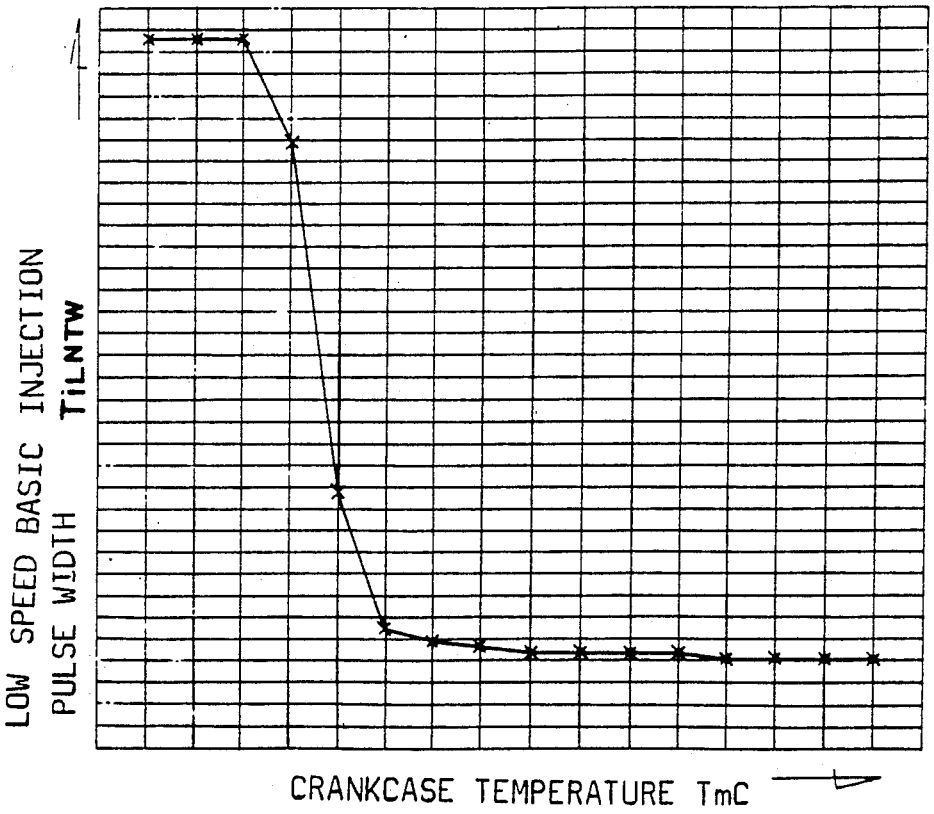
FIG. 8 is a graph showing a relationship between low speed basic injection pulse width and crankcase temperature.

The ECU 20 is further provided with a low speed basic injection pulse width providing section 51 to which the crankcase temperature TmC from the crankcase temperature sensor 6 is fed. The low speed basic injection pulse width providing section 51 retrieves a basic fuel injection pulse width TiLNTW for a low engine speed range from a basic fuel injection pulse width look-up table MPN. The low speed basic injection pulse width look-up table MPN is provided in the ROM 22 and stores a plurality of low speed basic injection pulse widths TiLNTW arranged in accordance with the crankcase temperature TmC, presenting characteristics shown in FIG. 8. The basic fuel injection pulse width for the low engine speed range may be calculated by interpolation based on the retrieved fuel injection pulse widths TiLNTW.

Figure 9:
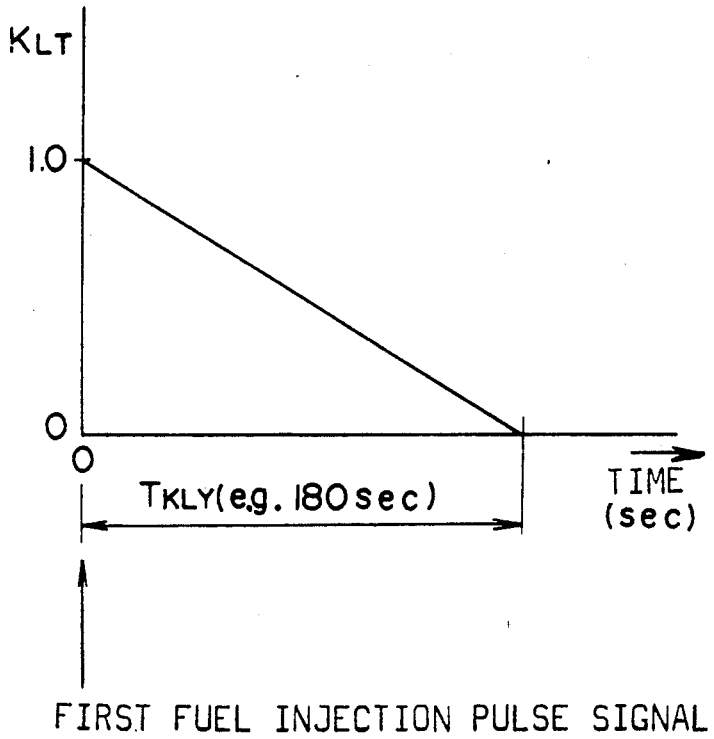
FIG. 9 is a graph showing the characteristic of time coefficient.

A time correction coefficient providing section 52 is fed with a fuel injection pulse signal from a driver 63, which is also fed to the injector 11, to count a time T1 since the first fuel injection pulse signal is fed. A time correction coefficient KLT is determined in dependency on the counted time T1 as a parameter. Referring to FIG. 9, at the time of the application of the first fuel injection pulse signal, the time correction coefficient KLT is set to 1 and decreases thereafter with elapse of time. More particularly, the time correction coefficient KLT is a correction coefficient for decreasing the fuel injection pulse width as the engine is warmed up so as to decrease the engine speed N. When the elapsed time T1 becomes larger than predetermined reference time TKLY, for example, 180 sec, the time correction coefficient KLT becomes 0.

Figure 10:
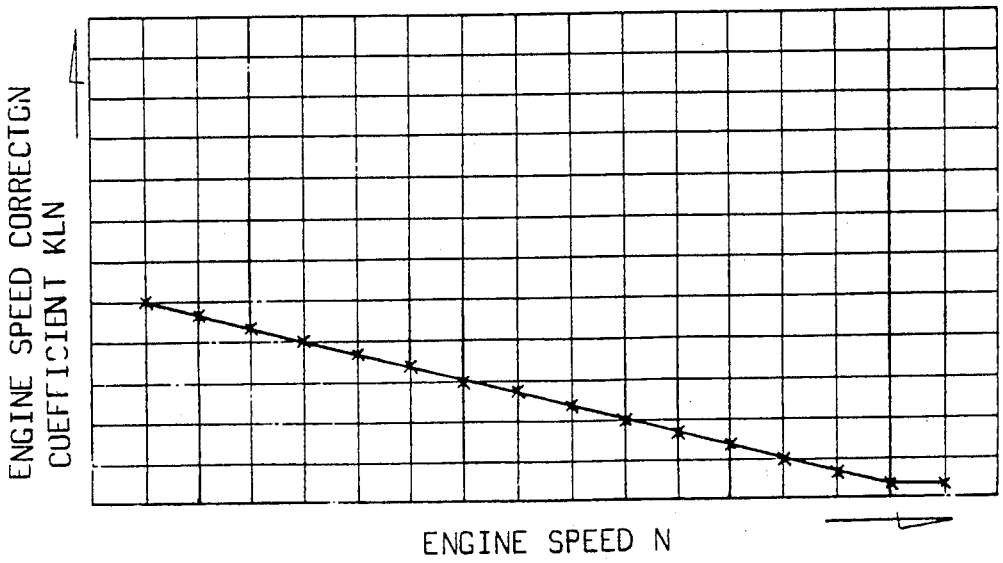
FIG. 10 is a graph showing engine speed correction coefficient and engine speed.

An engine speed correction coefficient providing section 54 is further provided for correcting the basic fuel injection pulse width TilNW for the low engine speed range. The engine speed correction coefficient providing section 54 is applied with the engine speed N calculated at the engine speed calculator 53 and retrieves an engine speed correction coefficient KLN from the engine speed correction coefficient look-up table MPLN in accordance with the engine speed N. The engine speed correction coefficient look-up table MPLN is provided in the ROM 22 and stores a plurality of engine speed correction coefficient KLN arranged in accordance with the engine speed N. As shown in FIG. 10, the engine speed correction coefficient KLN is set to a large value at a low engine speed and decreases as the engine speed increases. When the engine speed reaches a predetermined engine speed, the correction coefficient KLN is set to 0 so as to approximate the fuel injection pulse width Ti for the ordinary engine operating condition.

The low speed basic injection pulse width TilNTW, time correcting coefficient KLT, engine speed correction coefficient KLN and the altitude correction coefficient KALT obtained at the altitude correction coefficient providing section 58 are fed to a low speed injection pulse width calculator 55. The calculator 55 calculates a low speed injection pulse width TiLN in accordance with $$TiLN = TiLNTW \times KLT \times KLN \times KALT$$

The low injection pulse width TiLN and the ordinary engine speed fuel injection pulse width Ti are fed to a fuel injection pulse width comparing section 62 where the fuel injection pulse widths TiLN and Ti ar compared with each other. The larger of the fuel injection pulse widths TiLN and Ti is fed to the injector 11 through the driver 63.

When the elapsed time T1 from the start of the first fuel injection exceeds the reference time period TKLY so that the time correction coefficient KLT is 0, or when the engine speed exceeds the reference engine speed so that the engine speed correction coefficient KLN becomes 0, the low speed injection pulse width TiLN becomes 0. Thus, the ordianry fuel injection pulse width Ti is fed to the injector 11.

Describing the operation, when the engine is cranked, an alternating voltage generated in the exciter coil 41*a* is rectified by the diode D1 and applied to the capacitor C1 in the ignition circuit 33*a* to charge the capacitor.

The pulser coil 41*b* produces a reference signal voltage at a predetermined crank position and the voltage is applied to the gate of the thyristor SCR1 through the diode D3 and the resister R2.

When the voltage reaches a trigger level of the thyristor SCR1, the thyristor SCR1 becomes conductive so that the load charged in the capacitor C1 is discharged to a closed circuit comprising the capacitor C1, thyristor SCR1, primary coils of ignition coils 4*a*, and capacitor C1. Thus, high voltage of an extremely large positive going is produced in the secondary coils of the ignition coils 4*a* to ignite the spark plug 4.

At the same time, the pulse detecting circuit 33*c* detects the waveforms of pulses for the primary coils which are shaped by the waveform shaping circuit 33*d*, and a predetermined pulse duration of the pulses is determined by the duty control circuit 33*e*. The pulse generating circuit 33*f* generates the CDI pulse in synchronism with the source VIG. The fuel injection pulse is applied to the fuel injector 11 in synchronism with the CDI pulse to start the engine.

In order to stop the engine, one of the ignition switch 31 and the kill switch 32 is turned off so that off contacts of the switch close. Consequently, the voltage at the source VIG is applied to the gate of the thyristor SCR2 through the resister R1 and the diode D2 in the ignition source short-circuiting circuit 33*b* to render the thyristor SCR2 conductive. Thus, the source VIG is short-circuited through the resister R3 and the first diode D4, and the capacitor C2 is charged through the second diode D5.

As shown in FIG. 2, since the source VIG is the intermittent voltage, the source voltage VIG reduces to a ground level, so that the thyristor SCR2 becomes off. Consequently, the capacitor C2 discharges the current which is supplied to the base of the transistor TR to turn on the transistor.

When the source voltage VIG generates again, the current is directly supplied to the gate of the thyristor SCR2 through the second diode D5, transistor TR, resister R5, and diode D6. Thus, the thyristor SCR 2 is turned on again to short-circuit the source VIG and to charge the capacitor C2.

This process is repeated so that a necessary energy for igniting the spark plug 4 is not applied to the primary coils of the ignition coils 4. Consequently, the voltage is reduced lower than the limit value for the ignition, thereby stopping the engine.

In the system, if the kill switch 32 is turned off once to turn on the thyristor SCR2, the thyristor SCR2 is automatically turned on and off in accordance with the capacitor C2 and the transistor TR until the engine stops. Therefore, it is not necessary to maintain the kill switch 32 in off-state.

After the engine stops, the ECU 20 is supplied with the power from the battery through the self-shut relay 29 to be in a self-hold state. After a predetermined time elapses, the self-shut relay 29 is turned off to cut off the power to the control unit 20 and hence to stop the operation.

Figure 11A:
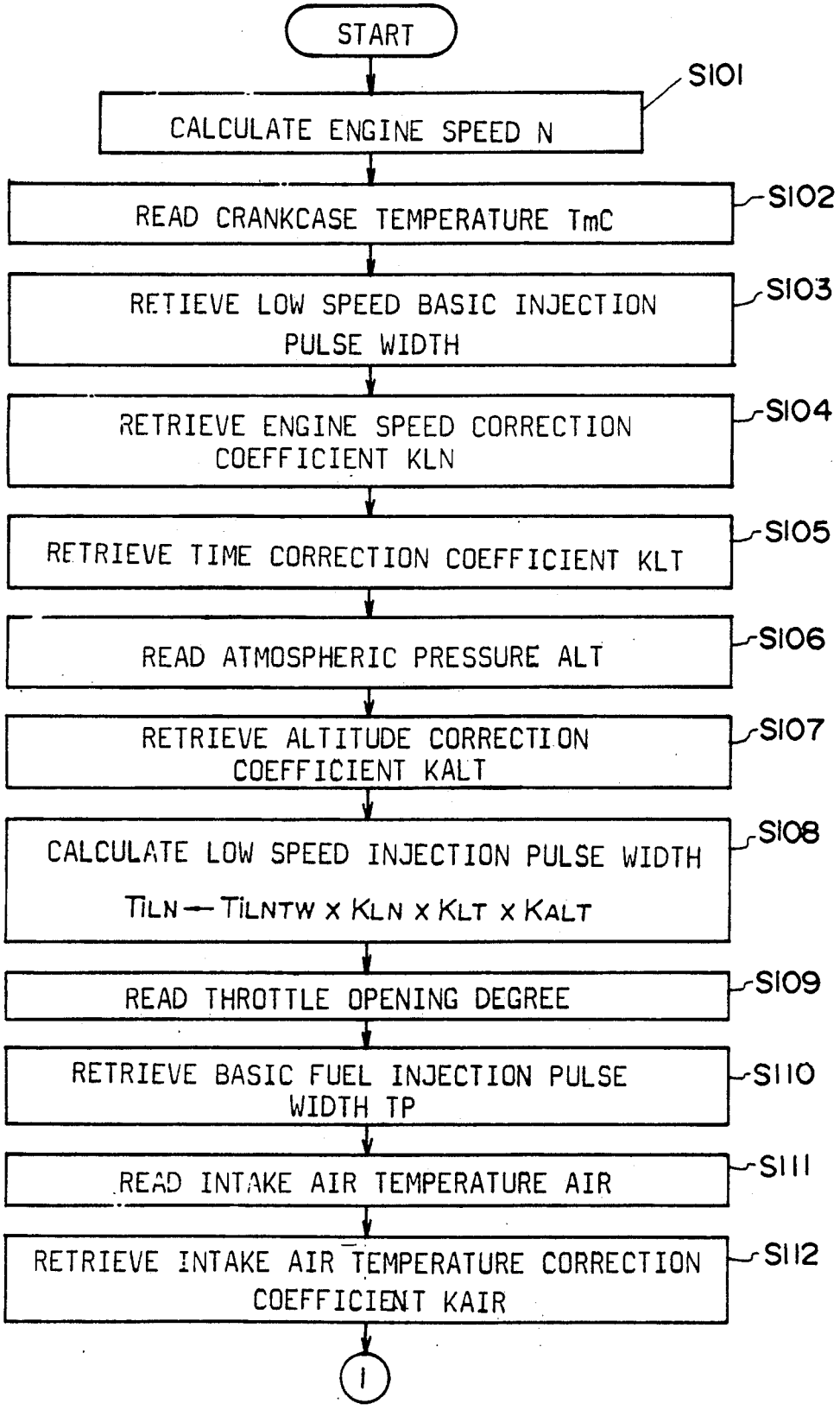
FIGS. 11*a* and 11*b* show a flowchart explaining the operation of the fuel injection pulse control system.
Figure 11B:
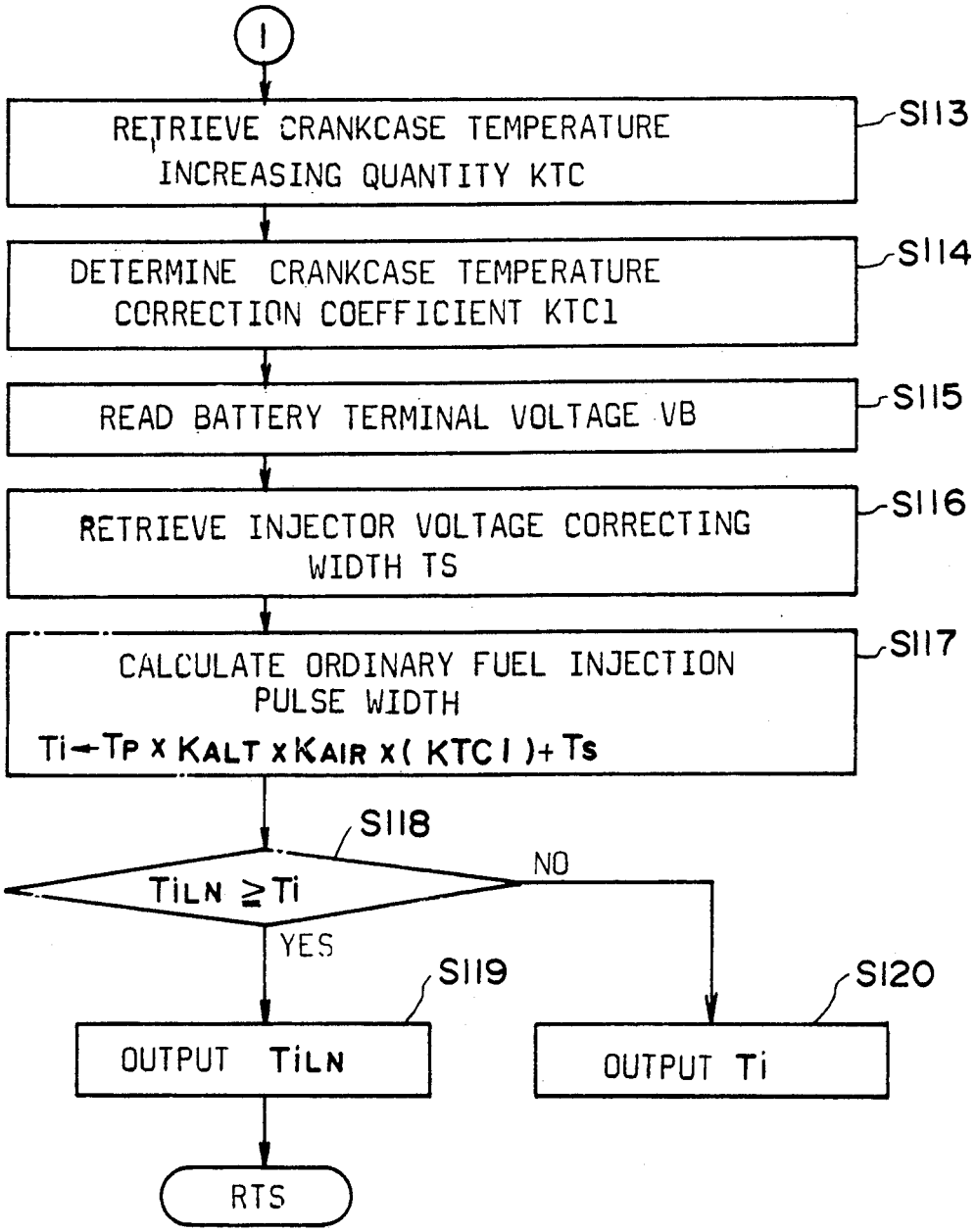

The operation of the system of the present invention for determining the fuel injection pulse width is described hereinafter with reference to FIGS. 11*a* and 11*b*. The program is repeated at a predetermined timing.

At a step S101, the cycle f is calculated in dependency on the interval between the input of the CDI pulses ($f = dT120/d\theta 1$ and the engine speed N is calculated based on the calculated cycle f ($N = 60/2\pi \cdot f$). At a step S102, the crankcase temperature TmC is read from the crankcase temperature sensor 6 and the low speed basic injection pulse width TiLNTW is retrieved from the look-up table MPN at a step S103. The basic fuel injection pulse width TiLNTW may be obtained by interpolation based on the pulse widths retrieved from the look-up table MPN. At a step S104, the engine speed correction coefficient KLN is retrieved from the engine speed correction coefficient look-up table MPLN in accordance with the engine speed N calculated at the step S101. At a step S105, the time correction coefficient KLT is determined. At a step S106, the atmospheric pressure ALT is read from the atmospheric pressure sensor 36. The program goes to a step S107 where the altitude correction coefficient KALT is retrieved from the altitude correction coefficient look-up table MPAT. At a step S108, the low speed injection pulse width TiLN is calculated based on the basic fuel injection pulse width TiNTW obtained at the step S103, engine speed correction coefficient KLN obtained at the step S104, time correction coefficient KLT obtained at the step S105, and the altitude correction coefficient KALT obtained at the step S107.

The program proceeds to a step S109 where the throttle opening degree $\alpha$ is read from the throttle position sensor 10. At a step S110, the basic fuel injection pulse width Tp is retrieved from the basic fuel injection pulse width look-up table MP $\alpha$ in accordance with the engine speed N calculated at the step S101 and the throttle opening degree $\alpha$ read at the step S109. The basic fuel injection pulse width Tp may be obtained by interpolation in dependency on the injection pulse widths retrieved from the table MP $\alpha$. The intak air temperature AIR is read from the intake air temperature sensor 13 at a step S111. The intake air temperature correction coefficient KAIR is obtained in dependency on the intake air temperature AIR at a step S112. At a step Sl13, the crankcase temperature increasing quantity KTC is retrieved from the look-up table MPTC in dependency on the crankcase temperature TmC obtained at the step S102. The increasing quantity may be calculated by interpolation in dependency on the increasing quantities retrieved from the table. At a step S114, the crankcase temperature correcting coefficient KTC1 is calculated.

The battery terminal voltage VB is read at a step S115, and the injector voltage correcting width Ts is obtained dependent on the terminal voltage VB at a step S116. The fuel injection pulse width Ti is calculated at a step S117 in dependency on the basic fuel injection pulse width Tp, altitude correction coefficient KALT, intake air temperature correction coefficient KAIR, crankcase temperature correction coefficient KTC1 and the injector voltage correcting width Ts obtained at the steps S110, S107, S112, S114 and S116, respectively.

At a step S118, the low speed injection pulse width TiLN calculated at the step S108 and the ordinary fuel injection pulse width Ti calculated at the step S117 are compared with each other. When the low speed injection pulse width TiLN is larger than the ordinary fuel injection pulse width Ti (TiLN>Ti). The program goes to a step S119 where the fuel injection pulse width TiLN is output. On the other hand, when the low speed injection pulse width TiLN is smaller than the pulse width Ti (TiLN≦Ti), the program proceeds to a step S120 to output the ordinary fuel injection pulse width Ti. The driving signal corresponding to the selected pulse width Ti or TiLN is fed to the injector 11 at the predetermined timing.

Thus, in accordance with the present invention, the fuel injection pulse width Ti for the ordinary engine operating condition and the low speed injection pulse width TiLN for the low engine speed range at the start of the engine are obtained. The fuel injection pulse widths Ti and TiLN are compared with each other and the larger of the two pulse widths is selected as an actual fuel injection pulse width. More particularly, at the start of the engine when the crankcase temperature is low, the low speed injection pulse width has a large value in accordance with the low crankcase temperature. Thus, a large quantity of fuel corresponding to the low speed injection pulse width TiLN is injected from the injector 11. Hence a good starting characteristics is obtained.

With the elapse of time T1, the fuel injection pulse width TiLN decrease so as to converge to the fuel injection pulse width Ti. After the predetermined time period TKLY, or when the engine speed exceeds a predetermined speed, the low speed injection pulse width TiLN becomes zero so that the fuel injection pulse width Ti is selected. Thus, the air-fuel mixture is prevented from becoming excessively rich, thereby decreasing the fuel consumption.

Figure 12:
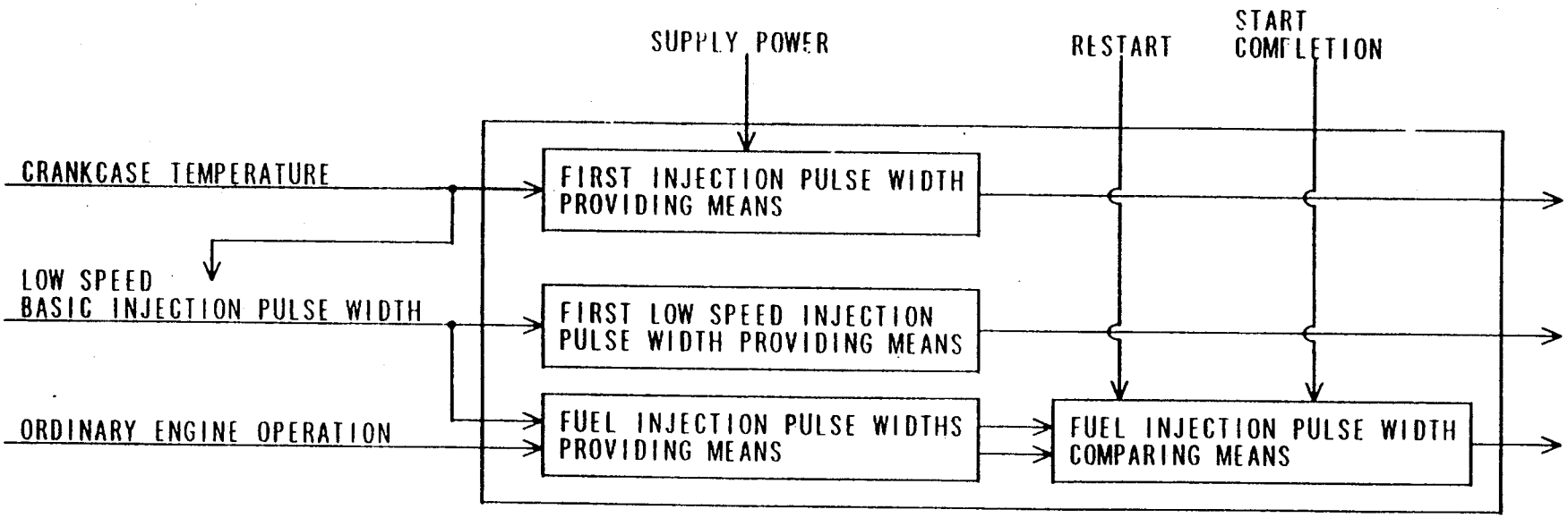
FIGS. 12 and 13 are block diagrams schematically showing a fuel injection control system and a self-shut relay control system of a second embodiment of the present invention, respectively.
Figure 13:
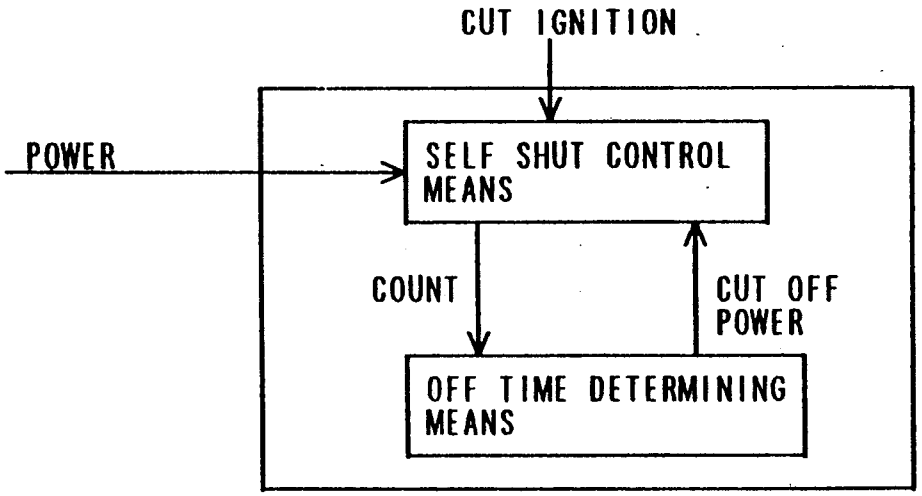
Figure 14A:
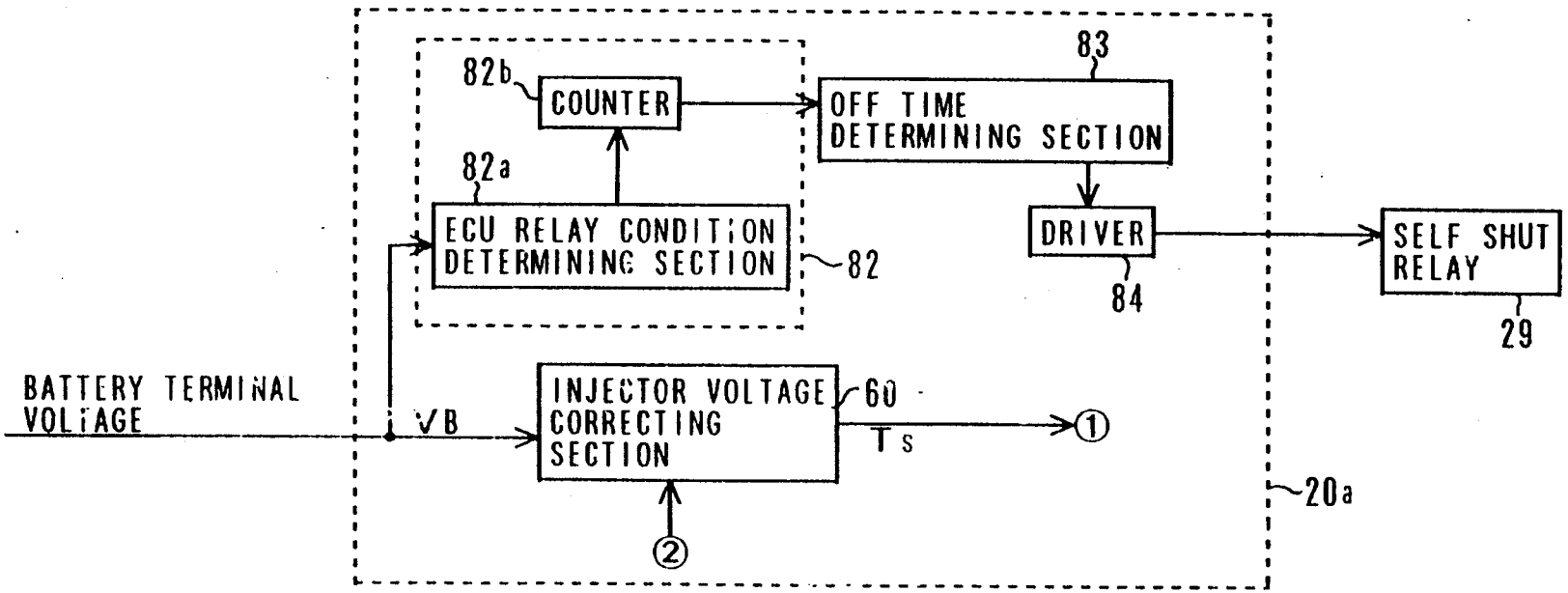
FIGS. 14*a* to 14*d* show a block diagram of the control unit of the second embodiment of the present invention.
Figure 14B:
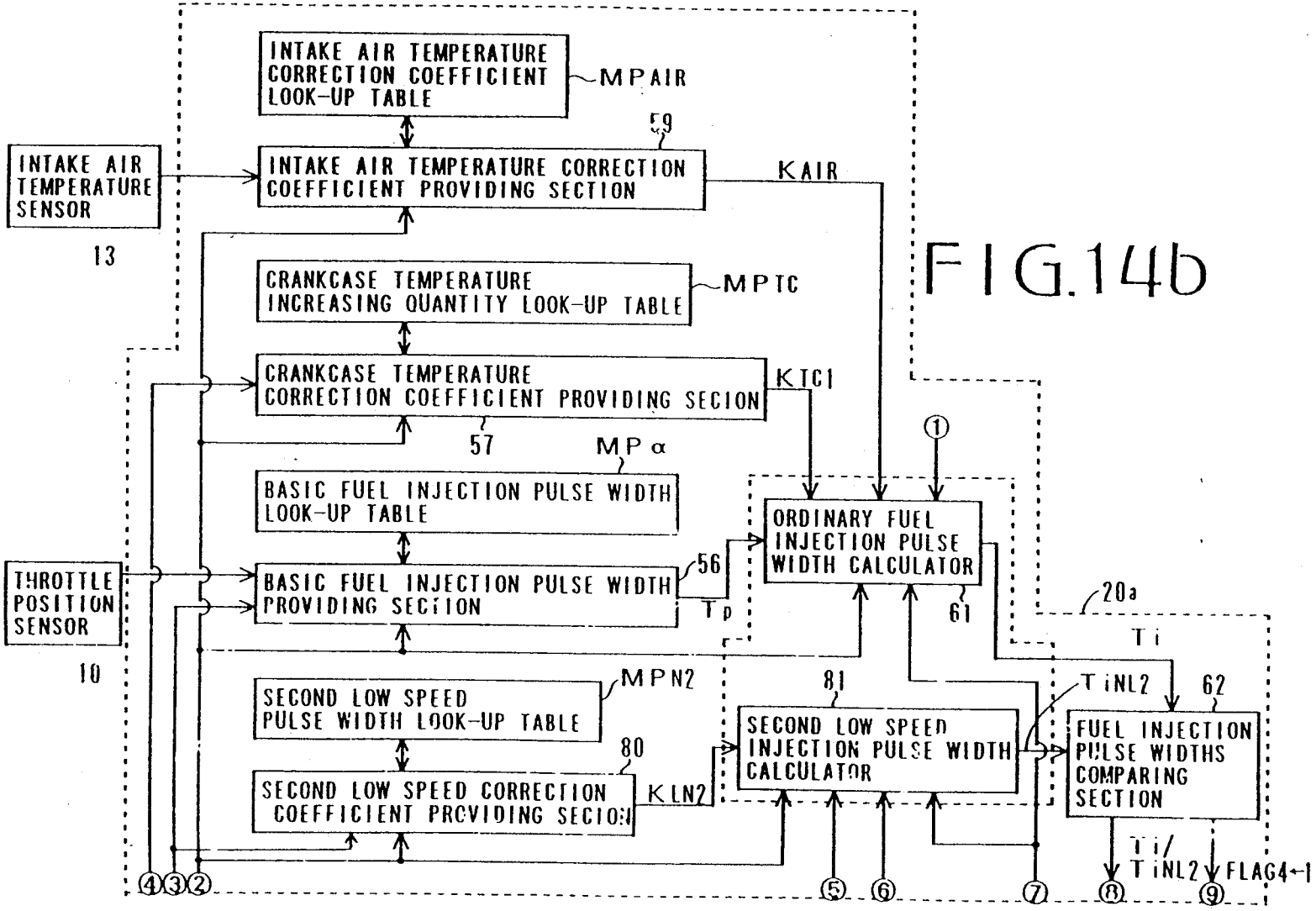
Figure 14C:
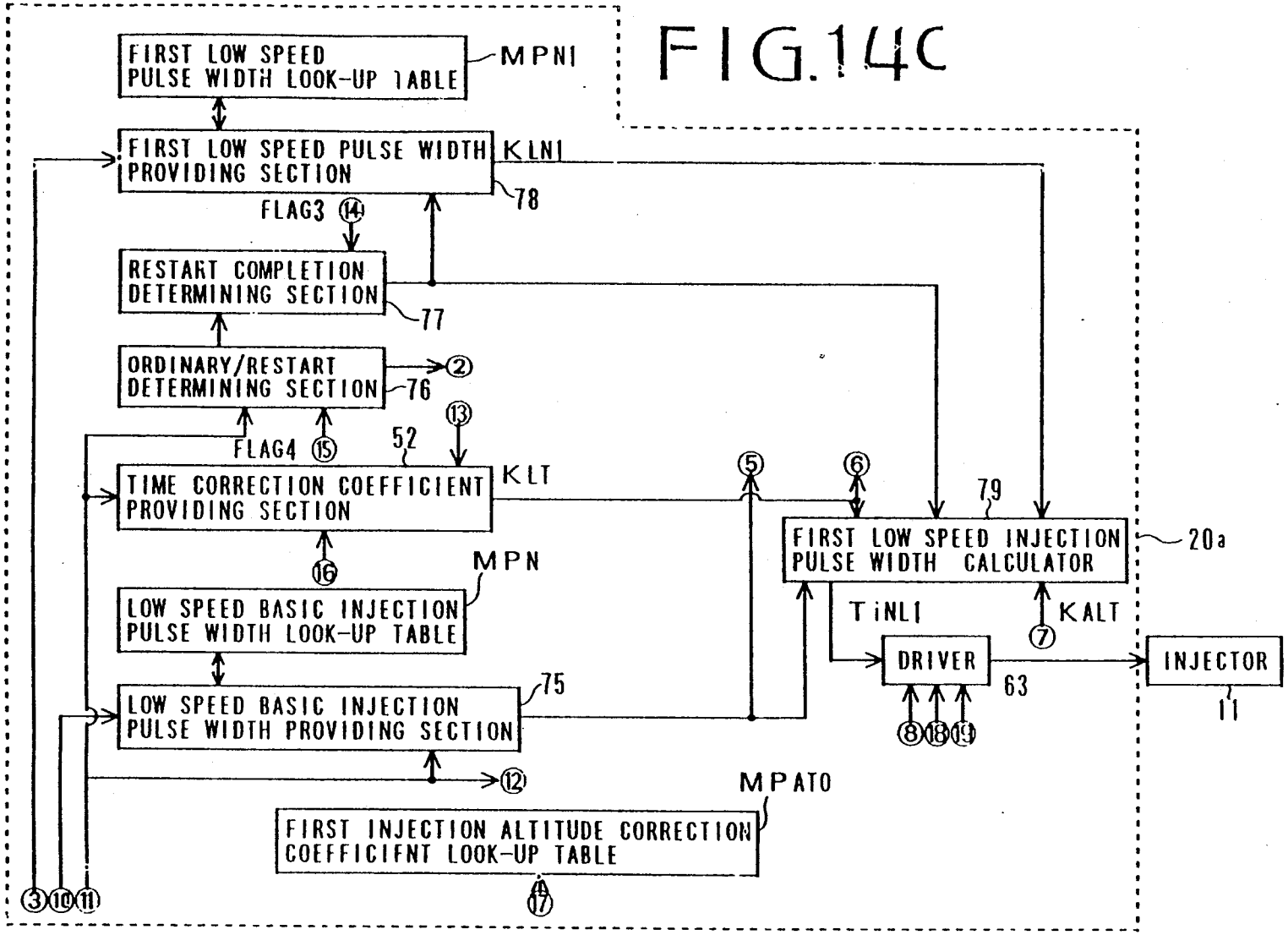
Figure 14D:
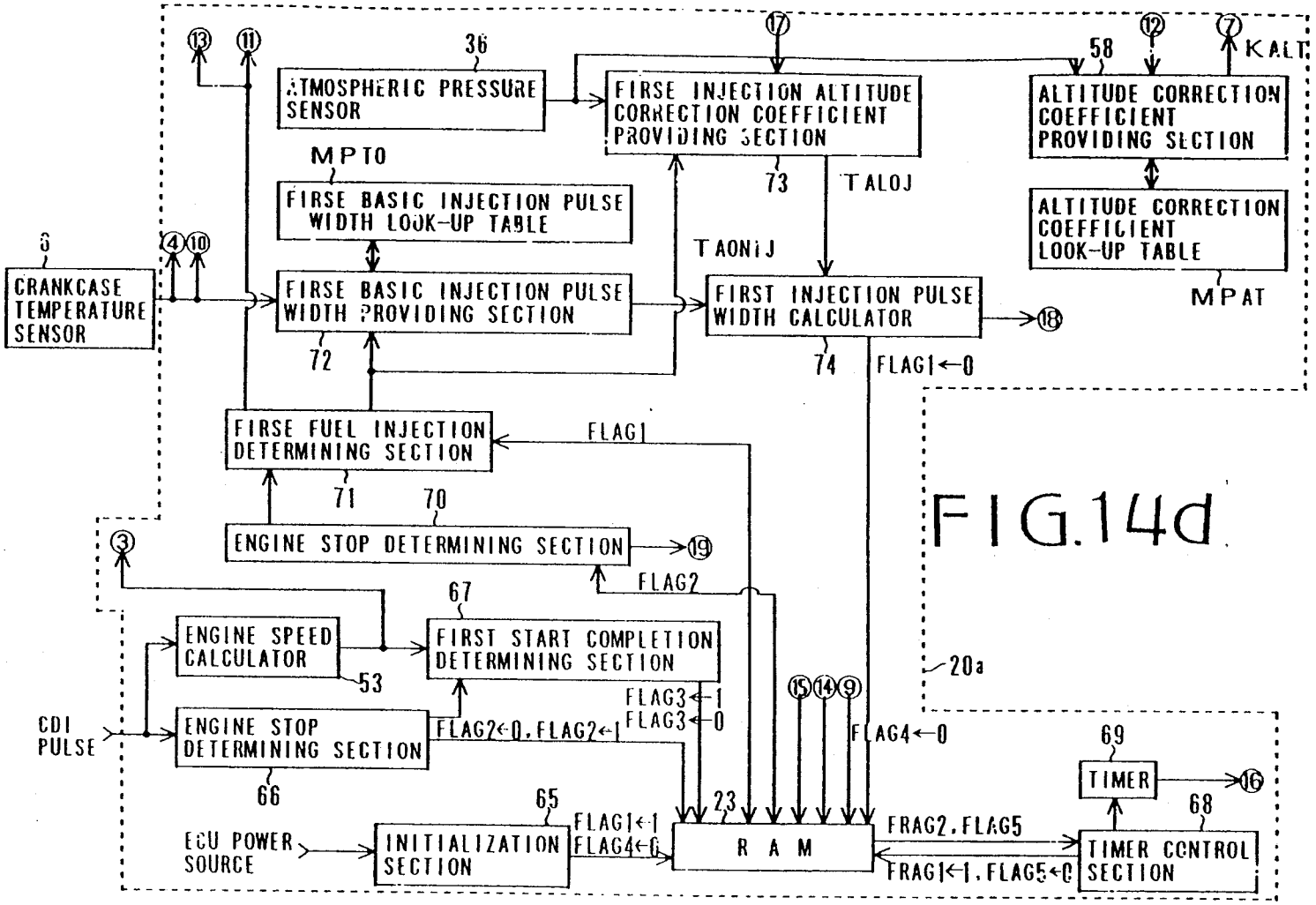

FIGS. 12 and 13 schematically show the control system of the second embodiment of the present invention. As shown in FIG. 12, when the power is supplied to the control unit to crank the engine, a first injection pulse width is determined at first injection pulse width providing means in accordance with the crankcase temperature. The first injection pulse width is applied to the injector to inject the fuel at the cranking of the engine. Thereafter, in order to complete the start of the engine, a first low speed injection pulse width is determined in accordance with the crankcase temperature at first low speed injection pulse width providing means. The first low speed injection pulse width is applied to the injector until the engine is started. When the completion of the start of the engine is determined, a second low speed injection pulse width having a smaller pulse width than the first low speed pulse width and an ordinary fuel injection pulse width are determined at fuel injection pulse widths providing means. The second low speed injection pulse width and the ordinary fuel injection pulse width are compared with each other at fuel injection pulse width comparing means, and the larger fuel injection pulse width is applied to the injector to maintain engine operation.

The control system of the second embodiment is further provided with a system for controlling the self-shut relay as shown in FIG. 13. When the ignition switch is turned off thereby cutting off the ignition, the engine stops. A self-shut control means starts to count the time and maintains the supply of the power to the control unit. When the elapsed time exceeds a predetermined time, an OFF time determining means operates to turn off the shut off control means. Thus, the supply of power is cut off.

The control system of the second embodiment of the present invention will be described more in detail with reference to FIGS. 14*a* to 14*d* to FIG. 18.

Referring to FIGS. 14*a* to 14*d*, an ECU 20*a* of the control system of the second embodiment has a system for obtaining the fuel injection pulse width Ti for the ordinary engine operation conditions as described in the control system of the first embodiment. The same numerals as those in FIGS. 4*a* and 4*b* designate the same parts in FIGS. 14*a* to 14*c* as FIGS. 4*a* and 4*b*, so that the descriptions thereof are omitted.

ECU 20*a* of the second embodiment has an initialization section 65 which is connected to a power source. When the power is supplied to the initialization section 65, a first time flag (FLAG 1) is set (FLAG 1←1) and a restart flag (FLAG 4) is reset (FLAG 4←0). The flags are stored in the RAM 23. The FLAG 1 is provided for indicating that the power to the ECU 20*a* is turned on and the engine is stopped. The FLAG 4 is for indicating that the engine is at a stop while the supply of the power is continued.

An engine stop determining section 66 which is fed with the CDI pulses counts the time interval T120 between sequential CDI pulse signals. When the time interval T120 is larger than a predetermined reference interval TSET, as 1 sec, (T120>TSET), the stop of the engine is determined, thus setting an engine stop flag (FLAG 2) provided in the RAM 23 (FLAG 2←1). When the time interval T120 is smaller than the reference interval TSET (T120≦TSET), it is determined that the engine is operated, thereby resetting the FLAG 2 (FLAG 2←0).

An engine first start completion determining section 67 is fed with a signal from the engine stop determining section 66 and the engine speed N calculated at the engine speed calculator 53, which is already described. When the engine speed N is smaller than a reference constant combustion speed NSET, such as RPM (N<NSET) the first start completion determining section 67 determines that the engine is started first time, thereby setting an engine start flag (FLAG 3) (FLAG 3←1) provided in the RAM 23. When the engine speed N becomes higher than the reference speed NSET (N≧NSET), the first start completion determining section 67 starts to count up a counter. When the count C1 reaches a predetermined set value C1SET, for example 2 seconds, the FLAG 3 is reset (FLAG 3←0). Namely, when the engine speed is maintained at a speed higher than the set speed NSET for the predetermined period of time, the first start determining section 67 determines that the first start of engine is completed.

An engine stop determining section 70 checks the state of the FLAG 2 stored in the RAM 23. When the FLAG 2 is set, the stop of the engine is determined so that the section 70 applies an engine stop signal to the driver 63 to stop the injection of fuel. When the FLAG 2 is reset, an engine operation signal is fed to a first injection determining section 71. The first injection determining section 71 further checks the first time FLAG 1 in the RAM 23. When the FLAG 1 is set, meaning that the power has just been turned on so that the first fuel injection is to be carried out, the first fuel injection determining section provides a first injection signal to a first basic fuel injection pulse width providing section 72. When the FLAG 1 is reset, which means that the first injection had already been performed, the first injection determining section 71 applies a low engine speed injection signal to a low speed basic injection pulse width providing section 75 and the time correction coefficient providing section 52.

Figure 15:
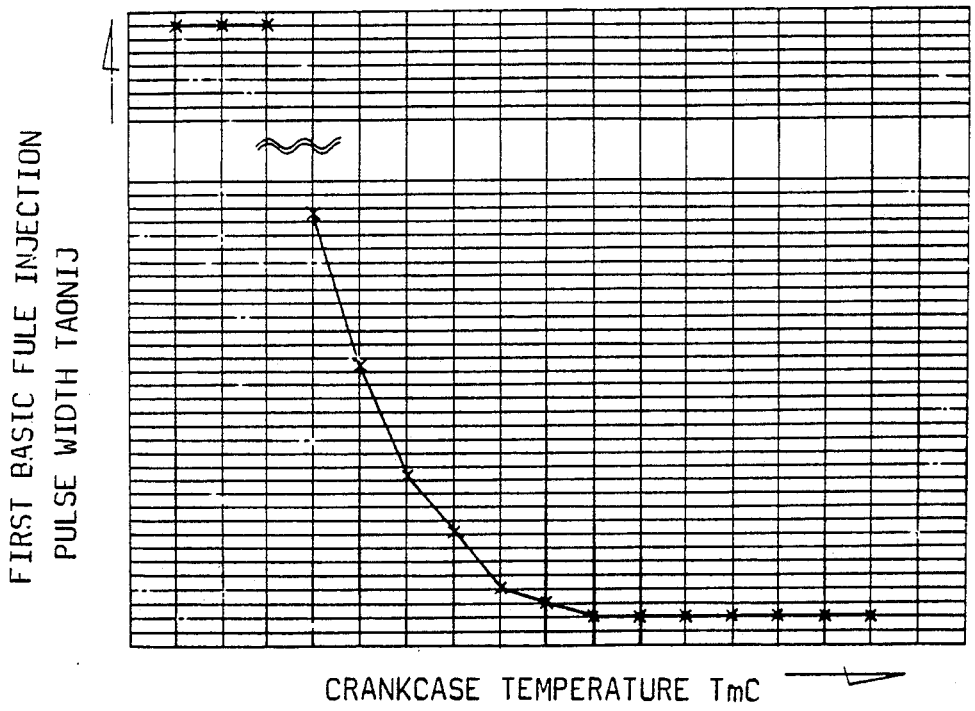
FIG. 15 is a graph showing a relationship between first basic injection pulse width and crankcase temperature.

The first basic injection pulse width providing section 72 retrieves a first basic injection pulse width TAONIJ from a first basic injection pulse width look-up table MPTO. The look-up table MPTO is provided in the ROM 22 and stores a plurality of first basic injection pulse widths TAONIJ arranged in accordance with the crankcase temperature TmC. As shown in FIG. 15, the first basic injection pulse width TAONIJ is set at a large value when the engine starts at a cold engine at a crankcase temperature below 20° C. so as to provide a pulse width larger than that for the ordinary engine operation. For starting the engine when the crankcase temperature TmC is higher than 20° C., a small basic pulse width is set to provide a smaller width than that for the ordinary fuel injection pulse width. The first basic injection pulse width may be calculated by interpolation based on the retrieved pulse widths TAONIJ.

Figure 16:
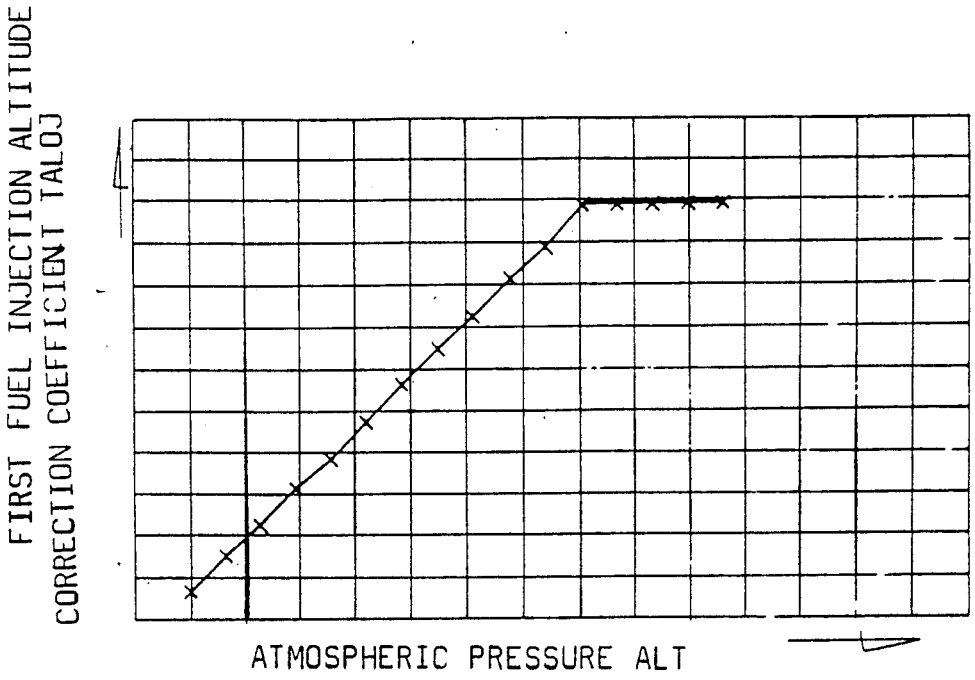
FIG. 16 is a graph showing first injection altitude correction coefficient and atmospheric pressure.

The first injection signal from the first injection determining section 71 is further fed to a first injection altitude correction coefficient providing section 73 for correcting the basic injection pulse width TAONIJ in dependency on the density of the intake air. The first injection altitude correction coefficient providing section 73 is applied with the atomospheric pressure ALT from the atmospheric pressure sensor 36 to retrieve a first injection altitude correction coefficient TALOJ from a first injection altitude correction coefficient look-up table MPATO. The look-up table MPATO, which is provided in the ROM 22, stores a plurality of first injection altitude correction coefficients TALOJ set as shown in FIG. 16. The altitude correction coefficient TALOJ is larger than the altitude correction coefficient KALT for the ordinary engine operation so as to improve the starting characteristics. The correction coefficient may be obtained by interpolation.

The first basic injection pulse width TAONIJ and the altitude correction coefficient TALOJ are fed to a first injection pulse width calculator 74 to calculate a first injection pulse width TonOUT as follows.

$$TonOUT = TAONIJ \times TALOJ$$

The pulse width TonOUT is fed to the injector 11 through the driver 63 to inject fuel, for the first time since the power is supplied to the ECU 20*a*, as a first fuel injection. At the same time, the injection pulse width calculator 74 applies a signal to the RAM 23 to reset the first time FLAG 1.

The low engine speed basic injection pulse width providing section 75, is fed with the low speed injection signal from the first fuel injection determining section after the first injection is carried out, and with the crankcase temperature TmC. The low speed basic injection pulse width providing section 75 retrieve the basic injection pulse width TiLNTW for low engine speed from the look-up table MPN in the same manner as in the first embodiment.

A timer control section 68 and a timer 69 are further provided in the ECU 20*a* for determining the time correction coefficient KLT. More particularly, when the FLAG 2 in the RAM 23 is set, that is the engine is not yet operated, the timer control section 68 operates to clear the timer 57 and to set a flag (FLAG 5) for a first injection pulse (FLAG 5←1). When the FLAG 5 is reset (FLAG 5←0) in accordance with the reset of the FLAG 2 (FLAG 2←0) at the operation of the engine, the timer control section 68 applies a trigger signal to the timer 69. Thus, the timer 69 is started, thereby feeding the time T1 after the first fuel injection to the time correction coefficient providing section 52. The time correction coefficient providing section 52 determines the time correction coefficient KLT which is set in accordance with the graph shown in FIG. 9.

The atmospheric pressure ALT from the atmospheric pressure sensor 36 is fed to the altitude correction coefficient providing section 58 for retrieving the altitude correction coefficient KALT from the altitude correction coefficient look-up table MPAT. The look-up table MPAT is already described in the description of the ECU 20 of the first embodiment.

An ordinary/restart determining section 76 checks the state of the restart FLAG 4 in accordance with an instruction from the first injection determining section 71. When the restart FLAG 4 is reset (FLAG 4←0), a command signal is fed to a restart completion determining section 77. On the other hand, when the FLAG 4 is set (FLAG 4←1), which means that the engine is ordinarily operated or that the engine had temporarily stopped and then restarted, a second injection pulse signal is fed to a second low speed pulse width correction coefficient providing section 80, basic injection pulse width providing section 56, crankcase correction coefficient providing section 57, intake air temperature correction coefficient providing section 59, injector voltage correcting section 60 and ordinary fuel injection pulse width calculator 61 to carry ut the computing process.

When the start completion signal is fed from the ordinary/restart determining section 76, the restart completion determining section 77 checks the engine start FLAG 3 in the RAM 23. When the engine start FLAG 3 is set (FLAG 3←1), indicating that the engine is still in the early stage of the operation, the restart completion detecting section 77 applies a first fuel injection signal to a first low speed pulse width correction coefficient providing section 78.

When the engine start FLAG 3 is reset, the restart completion determining section determines the completion of the restart of the engine, and applies instructions to the second low engine speed correction pulse width coefficient providing section 80, basic fuel injection pulse width providing section 56, crankcase correction coefficient providing section 57, intake air correction coefficient providing section 59, injector voltage correcting section 60 and the ordinary fuel injection pulse width calculator 61.

Figure 17:
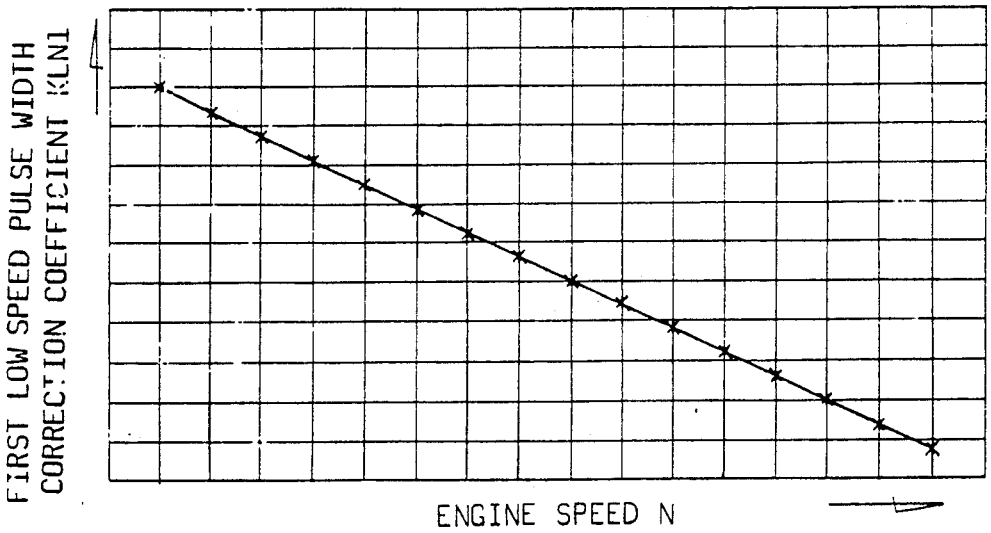
FIG. 17 is a graph showing a relationship between first low speed pulse width correction coefficient and engine speed.

The first low speed pulse width correction coefficient providing section 78 derives a first low speed pulse width correction coefficient KLN1 from a first low speed pulse width correction coefficient look-up table MPN1 in accordance with the engine speed N calculated by the engine speed calculator 53. The look-up table MPN1 is provided in the ROM 22 and stores a plurality of first low speed pulse width correction coefficients KLN1 arranged in accordance with the engine speed N. As shown in FIG. 17, the correction coefficient KLN1 is set at a large value at a low engine speed N to improve the starting characteristics at the start of the engine and decreases with an increase of the engine speed N.

The low injection basic pulse width TiLNTW from the low speed basic injection pulse width providing section 75, time correction coefficient KLT from the time correction coefficient providing section 52, altitude correction coefficient KALT and the first low speed correction coefficient KLN1 from the first low speed pulse width correction coefficient providing section 78 are fed to a first low speed pulse width calculator 79 to calculate a first low speed pulse width TiNL1 as follows.

$$TiNL1 = TiLNTW \times KLT \times KALT \times KLN1$$

The first injection pulse width TiNL1 is fed to the injector 11 thereby injecting the quantity of fuel corresponding to the pulse width TiNL1 at the injections after the first injection.

Figure 18:
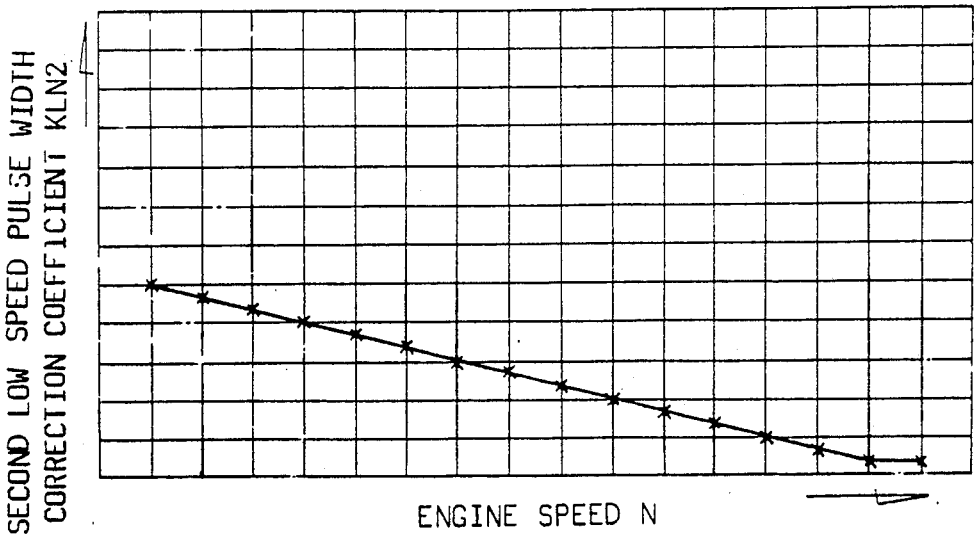
FIG. 18 is a graph showing a relationship between second low speed pulse width correction coefficient and engine speed.

The second low speed pulse width providing section 80 is fed with the engine speed N to retrieve a second low speed pulse width correction coefficient KLN2 from a second low speed pulse width correction coefficient look-up table MPN2. The look-up table MPN2 is provided in the ROM 22 and stores a plurality of second low engine speed pulse width correction coefficients KLN2 arranged in accordance with the engine speed N. As shown in FIG. 18, the correction coefficient KLN2 is set at a value which is one-half of that of the first low speed pulse width correction coefficient KLN1 so as to prevent the air-fuel mixture from becoming too rich at the restart of the engine. The correction coefficient KLN2 decrease with an increase of the engine speed and becomes zero after the engine speed reaches a predetermined value.

The low speed fuel injection basic pulse width TiLNTW from the low speed basic injection pulse width providing section 75, time correction coefficient KLT from the time correction coefficient providing section 52, altitude correction coefficient KALT and the second low speed correction coefficient KLN2 from the second low speed pulse width correction coefficient providing section 80 are fed to a second low speed pulse width calculator 81 to calculate a second low speed pulse width TiNL1 as follows.

$$TiNL2 = TiLNTW \times KLT \times KALT \times KLN2$$

The second fuel injection pulse width TiNL2 and the ordinary fuel injection pulse width Ti calculated by the ordinary fuel injection pulse width calculator 61 are fed to the fuel injection pulse widths comparing section 62 where the fuel injection pulse widths TiNL2 and Ti are compared with each other. The larger of the fuel injection pulse widths TiNL2 and Ti is fed to the injector 11. At the same time the FLAG 4 is set.

Due to the second low pulse width correction coefficient KNL2 and the time correction coefficient KLT, the second injection pulse width TiNL2 has a larger value than the injection pulse width Ti until the engine speed exceeds a predetermined reference value or after the elapse of the predetermined period of time TKLY.

The ECU 20*a* is further provided with self-shut control means 82.

The self-shut control means 82 comprises an ECU relay condition determining section 82*a* to which the battery voltage VB is applied for determining whether the ECU relay 28 is on or off. When the ECU relay 28 is on, the determining section 82*a* produces a drive signal which is applied to a driver 84 to energize the self-shut relay 29. When the relay 28 is energized, a drive signal is applied to a counter 82*b* for actuating the counter. The counter 82*b* starts counting an elapsed time after the ECU relay 28 is turned off and produces a count C2 which is applied to an OFF time determining section 83.

The counter 82*b* is operated as a timer which counts standard time clock pulse which is produced by dividing the system clock pulses of the ECU 20*a*.

The OFF time determining section 83 determines whether the count C2 of the counter 82*b* exceeds a predetermined standard time C2SET for turning off the self-shut relay 29 (for example ten minutes). When $C2 < C2SET$, the section 83 produces a signal for maintaining the self-shut relay 29 in on state through the driver 84. When $C2 \geqq C2SET$, it is determined that the ECU relay 28 is in off-state for the period, and a signal is applied to the driver 84 to turn off the self-shut relay 29.

When the driver 84 is applied with the drive signal from the ECU relay condition determining section 83, the driver 54 operates to excite the coil 29*a* of the self-shut relay 29 to turn off the relay 29. When the signal from the OFF time determining section 83 is applied, the coil 29*a* is de-energized to turn off the relay 29. Thus, the power to the control unit 20 is cut off to stop the operation of the system.

The operation of the control system of the second embodiment of the present invention is described hereinafter.

Figure 19:
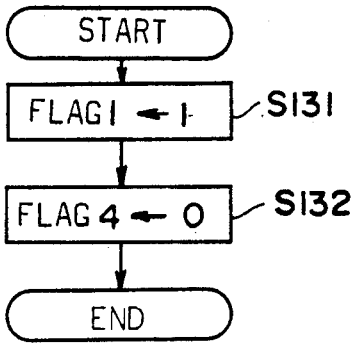
FIG. 19 is a flowchart showing the operation of an initialization program.

When both of the ignition switch 31 and the kill switch 32 are closed, an initialization program shown in FIG. 19 is carried out to initialize the control system. Namely, at a step S131, the first time flag (FLAG 1) is set and at a step S132, the restart flag (FLAG 4) is reset. The CDI unit is operated as the first embodiment.

When the above described initialization program is completed, a timer control program and a fuel injection pulse width determining program shown in FIG. 21 and FIGS. 22*a* to 22*c*, respectively are executed at a predetermined interval in accordance with the engine speed. Interrupt routines shown in FIGS. 20 and 23, that is, an engine operating condition determining program and a self-shut relay control program, are also executed at a predetermined interval.

Figure 20:
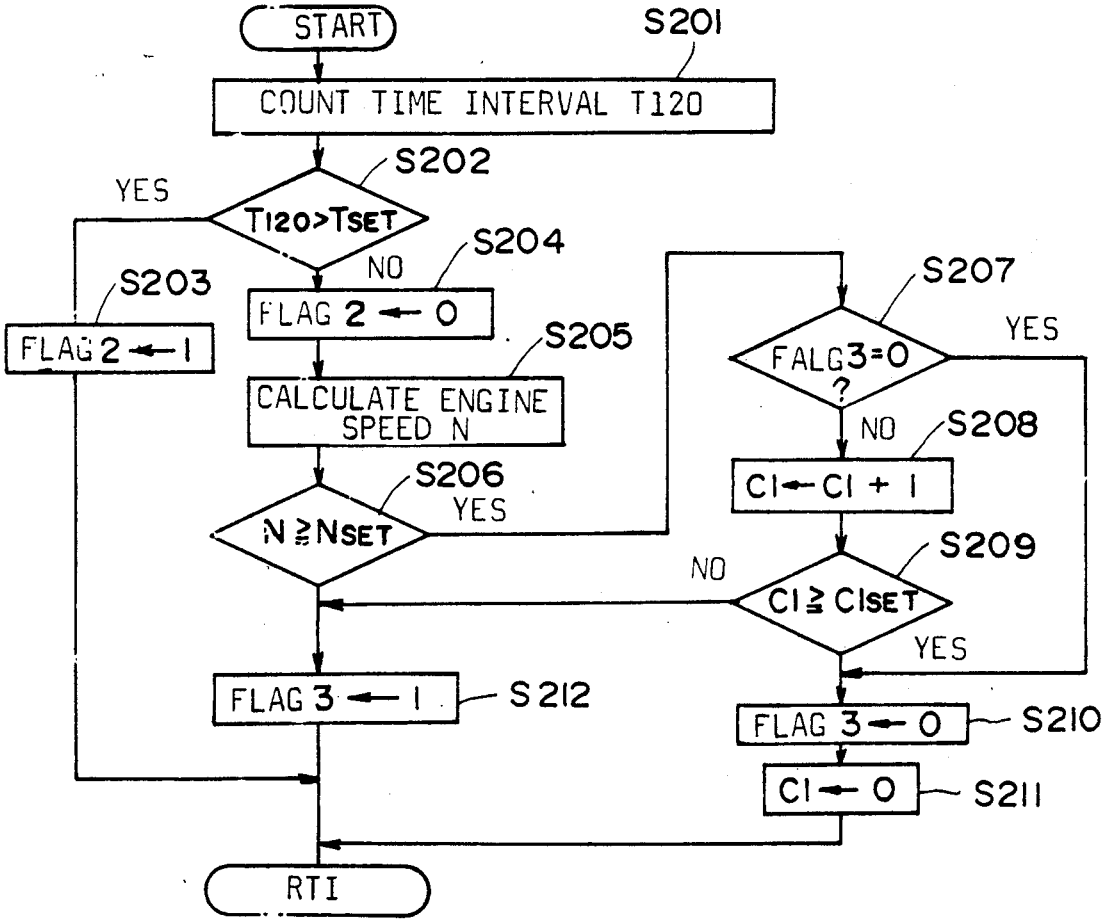
FIG. 20 is a flowchart showing the operation of an engine operating condition determining program.

Referring to FIG. 20, in the engine operating condition determining program, at a step S201, the time interval T120 between the CDI pulse signals from the CDI unit 33 are counted and at a step 202, the time T120 is compared with the reference time interval TSET. When $T120 > TSET$, it is determined that the engine is at a stop so that the program goes to a step S203 where the engine stop flag FLAG 2 is set. Thereafter, the program is repeated.

On the other hand, if $T120 \leqq TSET$, the program goes to a step S204 where the FLAG 2 is reset. At a step S205, the engine speed N is calculated based on the time interval obtained at the step S201 and stored in the RAM 23. AT a step S206, the calculated engine speed N is compared with the reference engine speed NSET. When the engine speed is lower than the reference speed ($N < NSET$), determining that the start of the engine is not yet completed, the program proceeds to a step S212. At the step S212, the engine start flag FLAG 3 is set.

If the engine speed N is higher than the reference speed NSET (N≧NSET), the engine is completely started. Thus, the program goes from the step S206 to a step S207 where it is determined whether the FLAG 3 is reset. When the FLAG 3 is set in the first routine after the start of the engine is determined, the program proceeds to a step S208 where the counter provided in the start completion determining section 67 is count up (C1←C1+1). When the count 1 reaches the reference value C1SET (C1≧C1SET), the program proceeds from a step S209 to a step S210. At the step S210, the FLAG 3 is reset, thereby indicating that the engine is started. At a step S211, the counter is cleared before the initialization program is executed. The reference value C1SET is determined in accordance with the interrupting time interval, for example at 2 seconds.

Figure 21:
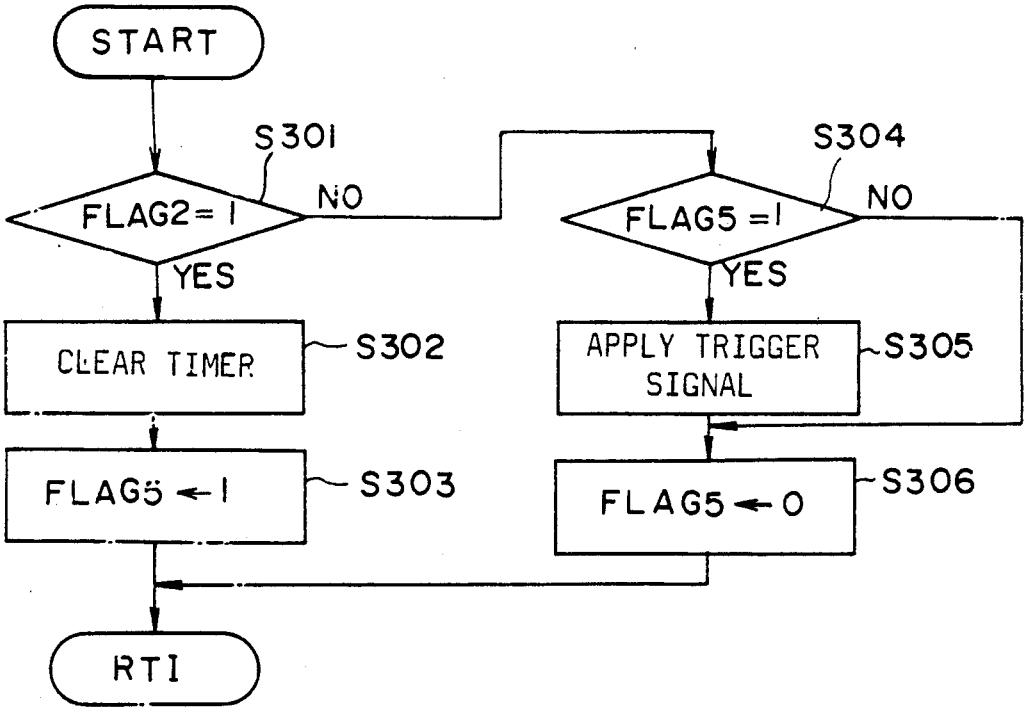
FIG. 21 is a flowchart showing the operation of a timer control program.

Referring to FIG. 21, the timer control program is described. At a step S301, it is determined whether the engine stop FLAG 2 is set, that is the engine is operated or not. When the FLAG 2 is set, that is, the engine is not yet started, the program goes to a step S302 to clear the timer 69. At a step S303, the first fuel injection flag (FLAG 5) is set, indicating that the injector has not yet injected fuel.

When it is determined at the step S301 that the engine is started and the FLAG 2 is reset, it is further determined at a step S304 whether the first injection pulse FLAG 5 is set or not. When the FLAG 5 is set, namely in the first interrupting routine after the start or the restart of the engine, the program goes to a step S305 where the trigger signal is applied to the timer 69 to start counting the time T1. Thereafter, the FLAG 5 is reset at a step S306. In the following routines, it is determined at the steps S304 that the FLAG 5 is reset to that the program jumps to the step S306. The program is repeated at a predetermined interval.

Figure 22A:
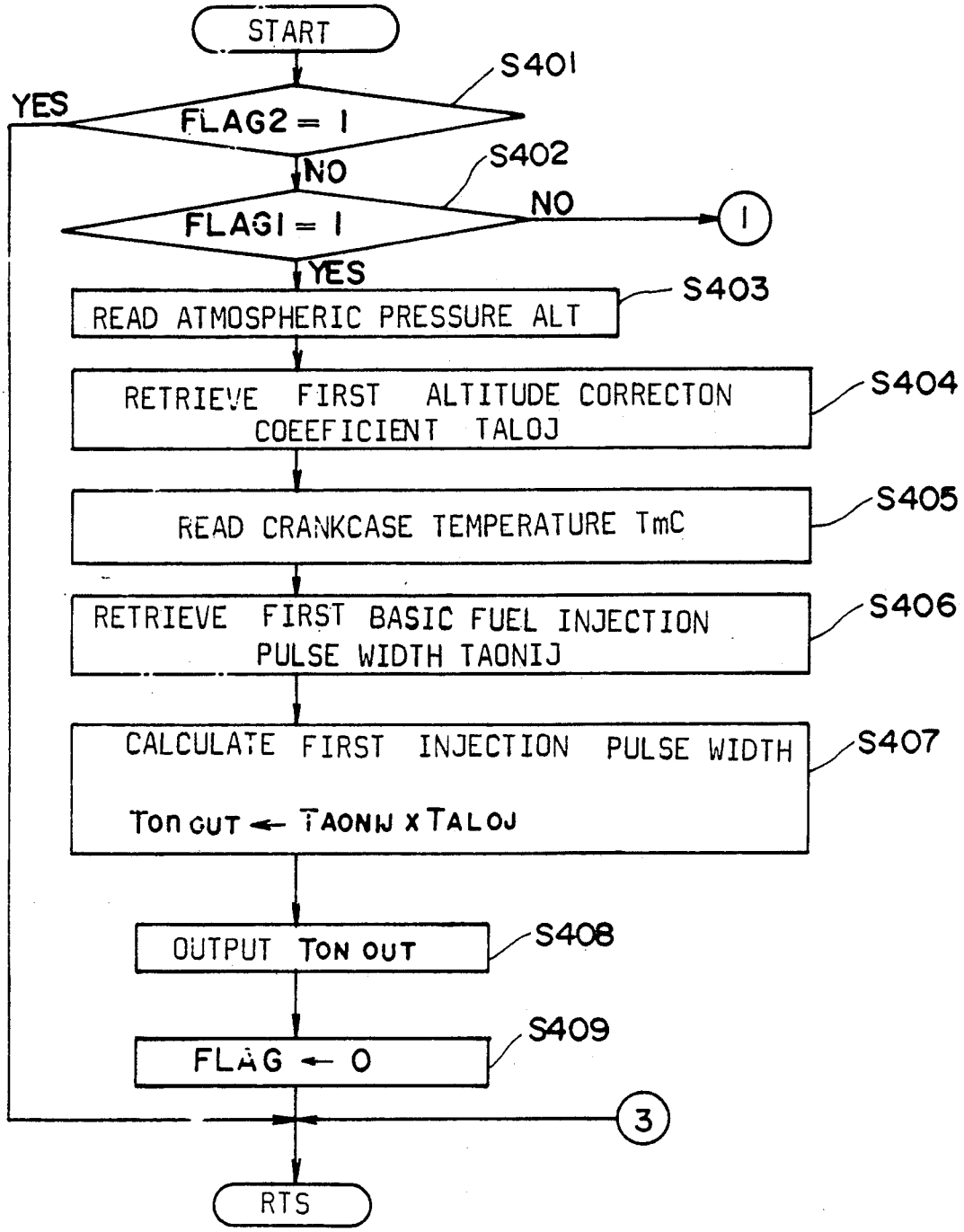
FIGS. 22*a* to 22*c* show a flowchart for explaining the operation of a fuel injection pulse width determining program.
Figure 22B:
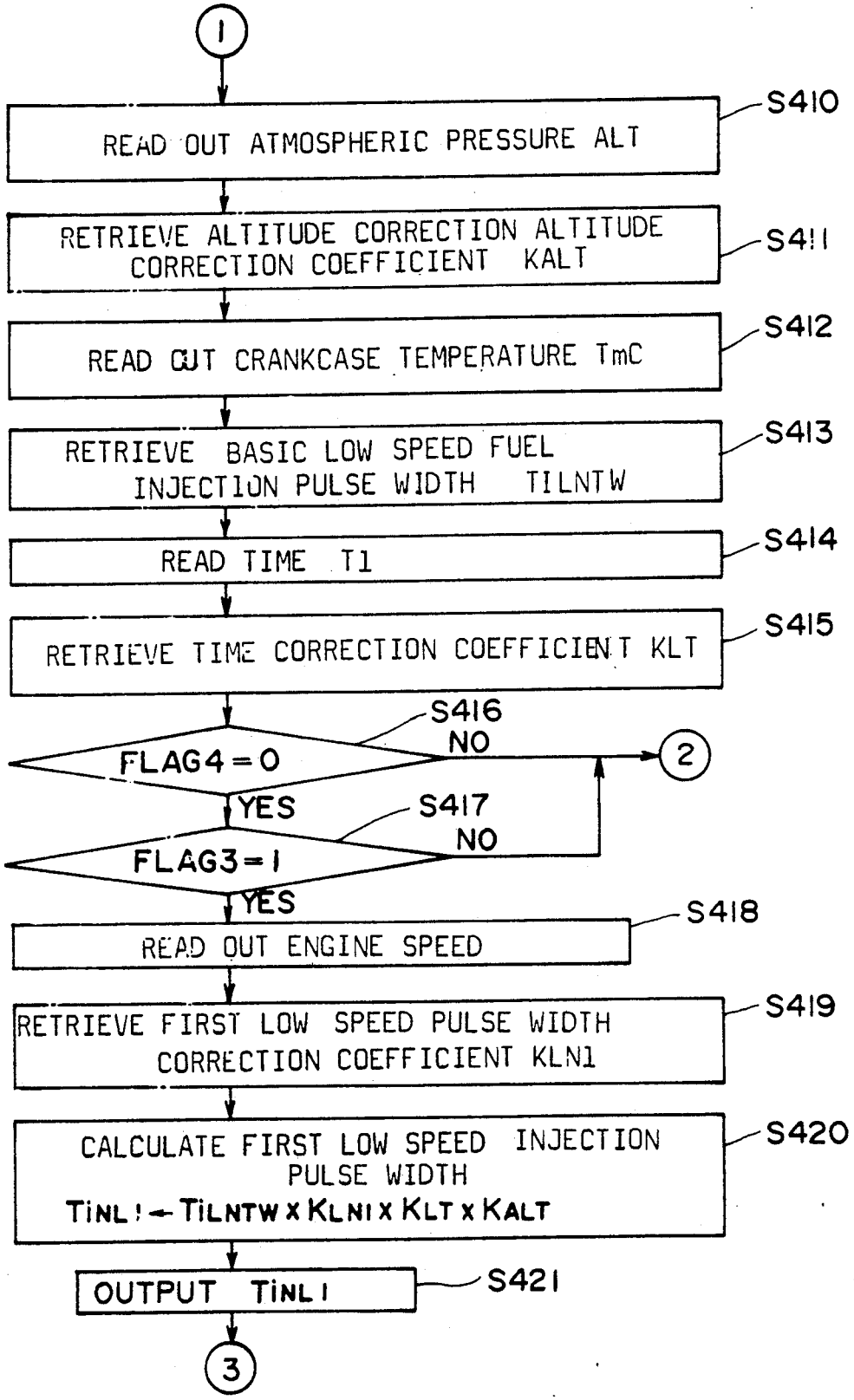
Figure 22C:
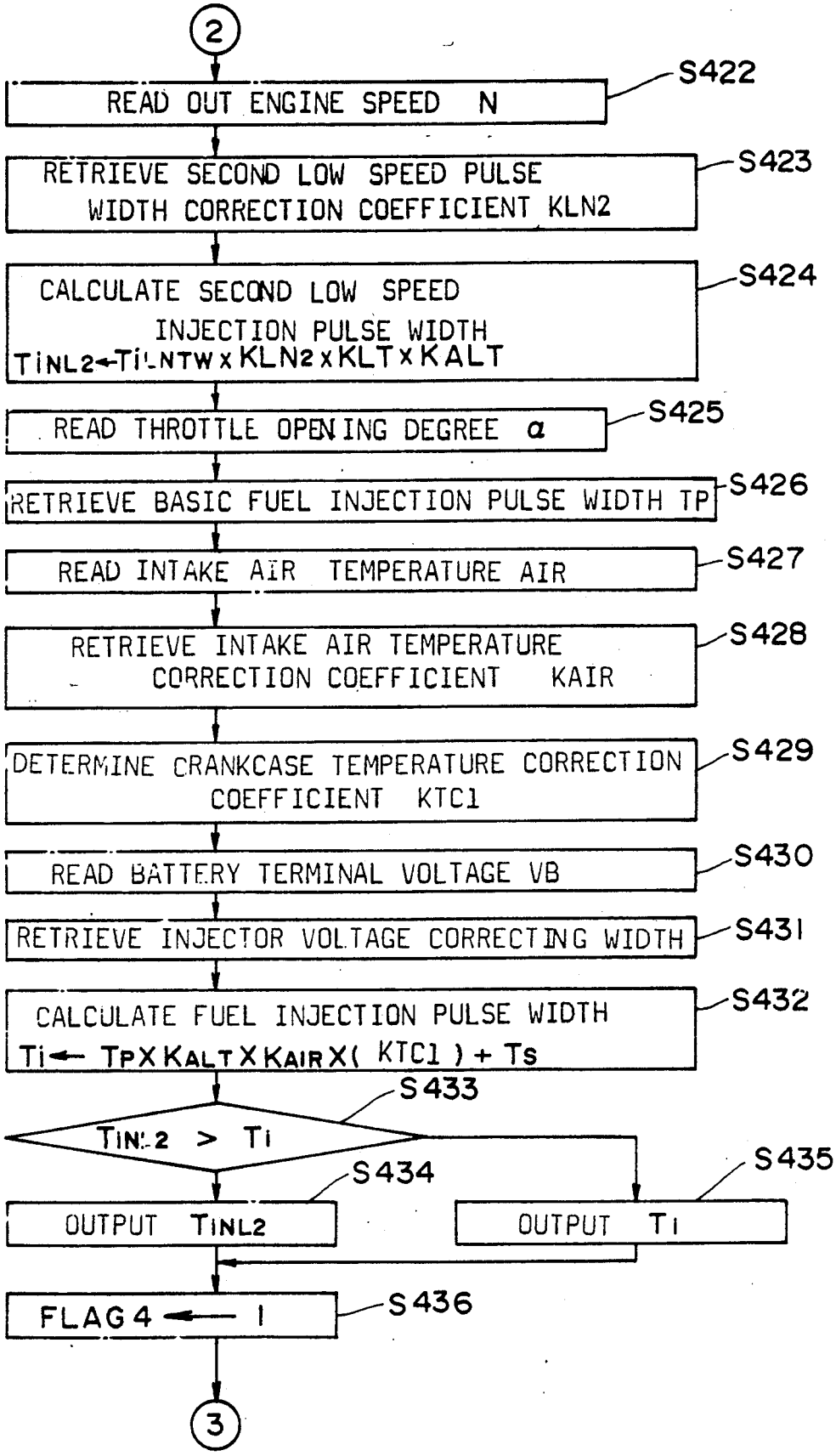

The fuel injection pulse width determining program is described hereinafter with reference to FIGS. 22*a* to 22*c*. At a step S401, whether the engine stop FLAG 2 is reset or not is determined. When the engine stop flag (FLAG 2) is set, that is at the engine stop, the program is terminated. When the FLAG 2 is reset, the engine is started and the program goes to a step S402 where it is determined whether the first time flag (FLAG 1) is set. If the FLAG 1 is set, the first routine is being carried out so that the program proceeds to a step S403.

At the step S403, the atmospheric pressure ALT from the atmospheric pressure sensor 36 is read and stored in the RAM 23 and at a step S404, the first altitude correction coefficient TALOJ is retrieved from the first fuel injection altitude correction coefficient look-up table MPATO in accordance with the retrieved atmospheric pressure ALT. At a step S405, the crankcase temperature TmC is read from the crankcase temperature sensor 6 and stored in the ROM 23. The first basic injection pulse width TAONIJ is retrieved from the first basic injection pulse width look-up table MPTO in accordance with the crankcase temperature TmC at a step S406. At a step S407, the first injection pulse width TonOUT is calculated. The first injection pulse width is applied to the injector 11 at a step S408, and at a step S409, the FLAG 1 is reset, indicating that the first routine is completed. Thus, at the start of the engine immediately after the power is supplied to the ECU 20*a*, the first fuel injection at the pulse width TonOUT is performed only once so as to be prepared for the start of the engine.

When it is determined at the step S402 that the FLAG 1 is reset, that is the second or one of the succeeding routines is being executed, the program goes to a step S410. At the step S410, the atmospheric pressure ALT stored in the RAM 23 is read out and at a step S411, the altitude correction coefficient KALT is retrieved from the altitude correction coefficient look-up table MPAT in accordance with the atmospheric pressure ALT. At a step S412, the crankcase temperature TmC is read out from the RAM 23 and at a step S413, the low speed basic injection pulse width TiLNTW is retrieved from the low speed basic injection pulse width look-up table MPN in accordance with the crankcase temperature TmC. The time T1 is read from the timer 69 at a step S414 and the time correction coefficient KLT is determined in dependency on the time T1 at a step S415.

At a step S416, it is determined whether the restart flag (FLAG 4) is set. When the FLAG 4 is set, that is at the restart of the engine, the program goes to a step S422. When the FLAG 4 is reset, that is, at the first routine, the program proceeds to a step S417 where it is determined whether the engine start flag (FLAG 3) is set or not. When the FLAG 3 is reset, that is when the engine is started, the program also goes to the step S422. To the contrary, if the FLAG 3 is set, indicating that the engine is first started, the program goes to a step S418.

At the step S418, the engine N is read out from the RAM 23 and the first low speed pulse width correction coefficient KLN1 is retrieved from the first low speed correction coefficient look-up table MPN1 in accordance with the engine speed N. The first low speed fuel injection pulse width TiNL1 is calculated at the step S420, based on the altitude correction coefficient KALT obtained at the step S411, the low speed basic injection pulse width TiLNTW obtained at the step S413, time correction coefficient KLT obtained at the step S415 and the first low speed pulse width correction coefficient KLN1 obtained at the step S420. At a step S421, the pulse width TiNL1 is output so that a quantity of fuel corresponding to the pulse width TiNL1 is injected at a predetermined crank timing as the second injection following the first fuel injection. The first low speed injection pulse width is increased in accordance with the low crankcase temperature, low engine speed and the fact that only a short time T1 elapsed since the start of the engine, thereby improving the starting characteristics of the engine.

When the engine is started, the program goes from the step S417 to the step S422 where the engine speed N is read out from the RAM 23. At a step S423, the second low speed pulse width correction coefficient KLN2 is retrieved from the second speed pulse width look-up table MPN2 in accordance with the engine speed N. At a step S424, the second low speed injection pulse width TiNL2 is calculated based on the altitude correction coefficient KALT obtained at the step S411, the low speed basic injection pulse width TiLNTW obtained at the step S413, time correction coefficient KLT obtained at the step S415 and the second low engine speed pulse width correction coefficient KLN2 obtained at the step S423.

The basic fuel injection pulse width Ti for the ordinary engine operating conditions is obtained through the succeeding steps S427 to S432. These steps correspond to the steps S109 to S117 in FIGS. 11*a* and 11*b* and the pulse width Ti is calculated in the same manner.

At a step S433, the second low speed injection pulse width TiNL2 calculated at the step S424 and the fuel injection pulse width Ti claculated at the step S432 are compared with each other. If the pulse width TiNL2 is larger than the pulse width Ti, the pulse width TiNL2 is fed to the injector 11 at a step S434. Thereafter, the FLAG 4 is set at a step S436. When the pulse width Ti is larger than the pulse width TiNL2, the program proceeds to a step S435 where the pulse width Ti is applied to the injector 11.

More particularly, immediately after the engine started, since the second low speed injection pulse width TiNL2, which is slightly smaller than the first low speed pulse width TiNL1, is larger than the ordinary fuel injection pulse width Ti, the fuel is injected at the pulse width TiNL2. With the increase of the engine speed N and the elapsed time T1, the second low engine speed fuel injection pulse width TiNL2 decreases so as to approximate to the fuel injection pulse width Ti. When the pulse width TiNL2 becomes smaller than the pulse width Ti, the pulse width Ti is selected. Hence the quantity of fuel to be injected is determined in accordance with the engine operating conditions.

When it is determined at a step S416 that the restart FLAG 4 is set, which means that the second low speed injection pulse width TiNL2 or the fuel injection pulse width Ti had been output in the previous routines, the program proceeds to the step S422. Thus, when the engine is stopped after the engine is started without cutting the supply of power to the ECU 20*a*, for example at a stall of the engine, the program is continued at the restart, omitting the first fuel injection at the pulse width TonOUT and the first low speed injections at the pulse width TiNL1. Hence, particularly in the two-cycle engine where the crankcase temperature is liable to become high or the fuel may be left in the cylinder, the air-fuel mixture is prevented from becoming too rich for appropriately restarting the engine.

Figure 23:
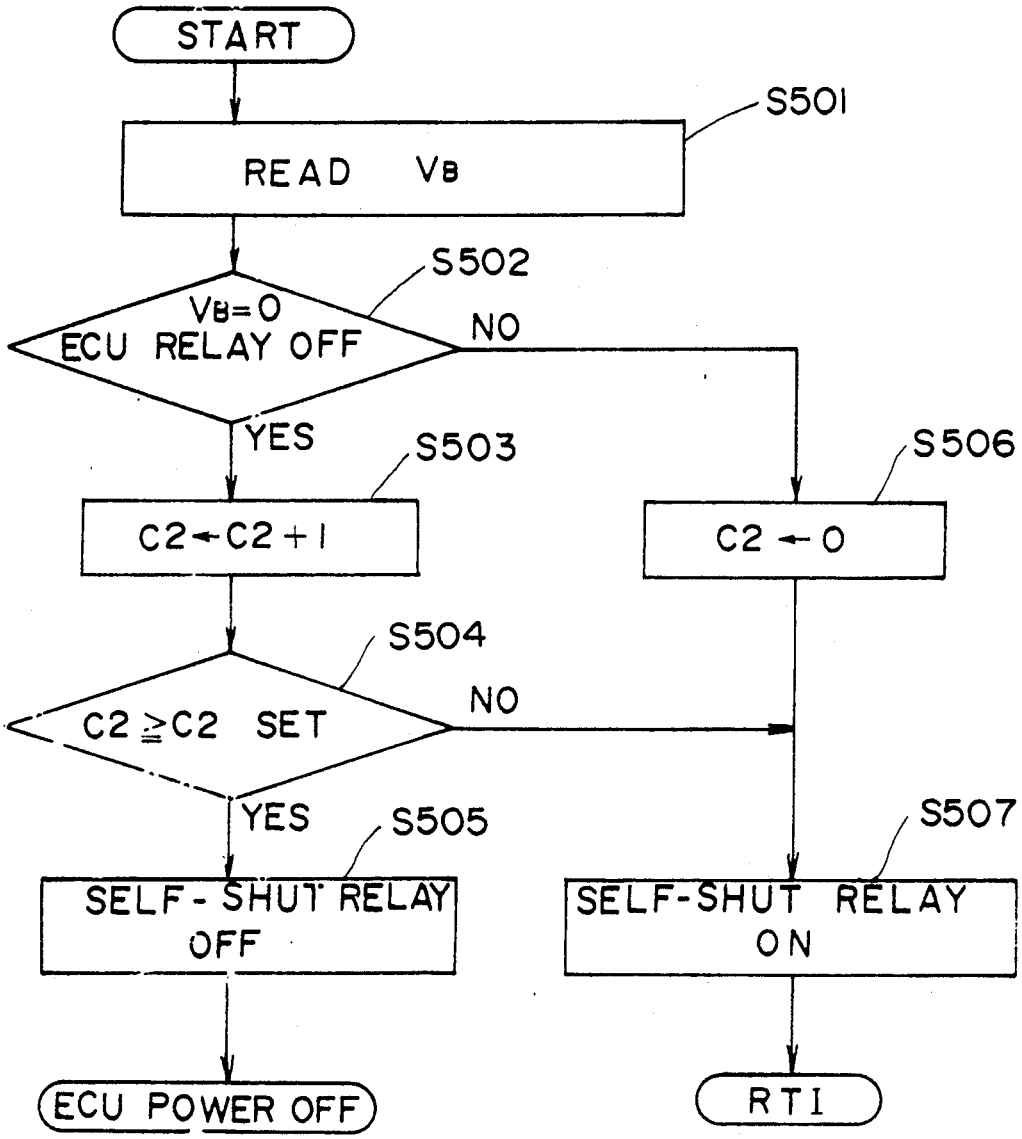
FIG. 23 is a flowchart showing the operation of a self-shut relay control program.

The operation of the self-shut relay 29 is described hereinafter with reference to the flowchart of FIG. 23. The program is executed as interruption at every predetermined time during the power is supplied to the ECU 20*a*.

At a step S501, the voltage VB at the terminal of the ECU relay 28 is read. At a step S502, it is determined whether the voltage VB is zero or not, namely, the ECU relay 28 is turned off or not. When VB=0, it is determined that one of the switches 31 and 32 is turned off to turn off the relay 28 so that the engine stops. The program goes to a step S503 where the count C2 of the counter is incremented with 1 (C2←C2+1). At a step S504, the count C2 is compared with the predetermined set value C2SET. When C2<C2SET, it is determined that the engine is still in hot engine condition. Consequently, the program goes to a step S507 where the self-shut relay 29 is kept turning on and the program is repeated. When C2≧C2SET, it is determined that the engine is cooled to a predetermined temperature, and the program proceeds to a step S505 where the self-shut relay 29 is turned off to cut off the power to the ECU 20*a*. Thus, the operation is stopped. In other words, the ECU 20*a* is kept to be supplied with power for a predetermined period of time after stop of the engine, thereby maintaining the data for operating the engine for the period. The data stored in the RAM 23 are held so as to be prepared for restarting the control unit.

On the other hand, when VB=0 at the step S502, it is determined that the ECU relay 28 is turned on and the engine is under operation. The program goes to a step S506 where the count C is cleared (C←0), and the program goes to the step S507.

Thus, although switch is turned off to stop the engine, the supply of the power to the ECU 20*a* is maintained. If the engine is restarted within the predetermined period of time where the engine is still hot, the fuel injection pulse width determining program is resumed. As a result, the air-fuel mixture is prevented from becoming excessively rich. Hence the engine can be easily restarted and the fuel consumption can be restrained.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A fuel injection control system for a two-cycle engine having a crankcase, a fuel injector and a microcomputer for controlling the engine in accordance with operating conditions of the engine, the system comprising:

a crankcase temperature sensor for detecting temperature of the crankcase;

low speed pulse width providing means for providing a low speed basic injection pulse width based on the detected crankcase temperature;

first correcting means for reducing said low speed basic injection pulse width with an elapse of time for providing a low speed injection pulse width;

ordinary pulse width providing means for providing an ordinary fuel injection pulse width in accordance with engine operating conditions;

comparator means for comparing said low speed injection pulse width and said ordinary fuel injection pulse width with each other and for determining a larger injection pulse width; and driving means for operating said fuel injector at the larger injection pulse width.

2. The system according to claim 1 further comprising second correcting means for correcting the ordinary fuel injection pulse width with the detected crankcase temperature.

3. The system according to claim 1 further comprising first pulse width providing means for providing a first injection pulse width based on the detected crankcase temperature at cranking of the engine.

* * * * *